US009033330B2

(12) United States Patent
Tokuma

(10) Patent No.: US 9,033,330 B2
(45) Date of Patent: May 19, 2015

(54) SHEET PROCESSING APPARATUS WITH TWO IMAGE FORMING DEVICES

(71) Applicant: CANON KABUSHIKI KAISHA, Tokyo (JP)

(72) Inventor: Naoto Tokuma, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 36 days.

(21) Appl. No.: 13/709,407

(22) Filed: Dec. 10, 2012

(65) Prior Publication Data

US 2013/0214475 A1 Aug. 22, 2013

(30) Foreign Application Priority Data

Feb. 17, 2012 (JP) ..... 2012-032392

(51) Int. Cl.

| | |
|---|---|
| ***B65H 37/04*** | (2006.01) |
| ***B65H 29/00*** | (2006.01) |
| ***B65H 31/02*** | (2006.01) |
| ***B65H 31/20*** | (2006.01) |
| ***B65H 31/36*** | (2006.01) |
| ***B65H 31/38*** | (2006.01) |
| ***B65H 39/06*** | (2006.01) |
| ***B42C 1/12*** | (2006.01) |
| ***G03G 15/00*** | (2006.01) |
| ***B65H 5/26*** | (2006.01) |

(Continued)

(52) U.S. Cl.

CPC ..... *B65H 29/00* (2013.01); *B65H 31/02* (2013.01); *B65H 31/20* (2013.01); *B65H 31/36* (2013.01); *B65H 31/38* (2013.01); *B65H 39/06* (2013.01); *B65H 2301/4212* (2013.01); *B65H 2301/4213* (2013.01); *B65H 2408/1222* (2013.01); *B65H 2511/51* (2013.01); *B65H 2513/512* (2013.01); *B65H 2601/2525* (2013.01); *B65H 2701/18292* (2013.01); *B65H 2801/27* (2013.01); *B42B 4/00* (2013.01); *B42C 1/12* (2013.01); *G03G 15/6552* (2013.01); *B65H 5/26* (2013.01); *B65H 7/02* (2013.01); *B65H 2513/50* (2013.01)

(58) Field of Classification Search

CPC ..... B65H 37/04
USPC ..... 270/58.08, 58.11, 58.12; 399/410
See application file for complete search history.

(56) References Cited

U.S. PATENT DOCUMENTS

| | | | | |
|---|---|---|---|---|
| 4,733,856 | A * | 3/1988 | Gunther, Jr. | 270/1.02 |
| 5,285,249 | A * | 2/1994 | Mahoney | 399/410 |
| 5,462,399 | A * | 10/1995 | Clupper et al. | 414/790.3 |

(Continued)

FOREIGN PATENT DOCUMENTS

JP 2004-093984 A 3/2004

*Primary Examiner* — Patrick Mackey
(74) *Attorney, Agent, or Firm* — Fitzpatrick, Cella, Harper & Scinto

(57) ABSTRACT

A first discharging portion that discharges a sheet received from one of image forming apparatus and a second discharging portion discharges a sheet received from another image forming apparatus are disposed opposite each other to stack the sheets discharged in a common processing tray. A controller controls the first and second discharging portions when the sheets are continuously discharged by the first and second discharging portions, controls a timing when the sheets are discharged by the first discharging portion and the second discharging portion to the common processing tray such that a leading edge of the sheet discharged from one of the discharging portions abuts on a sheet surface in the downstream of a discharging direction below a leading edge of the sheet discharged from the other discharging portion.

16 Claims, 19 Drawing Sheets

(51) Int. Cl.
*B65H 7/02* (2006.01)
*B42B 4/00* (2006.01)

(56) References Cited

U.S. PATENT DOCUMENTS 5,810,346 A * 9/1998 Jorg ..... 270/59
6,044,246 A * 3/2000 Tashiro et al. ..... 399/410
7,100,911 B2 * 9/2006 Middelberg et al. ..... 271/9.01
7,396,012 B2 * 7/2008 Bobrow ..... 271/185
7,503,555 B2 * 3/2009 Dobrovolsky ..... 270/58.07
7,510,182 B2 * 3/2009 Bobrow ..... 271/185
7,584,949 B2 * 9/2009 Kaneko et al. ..... 270/58.12
7,631,859 B2 * 12/2009 Milillo et al. ..... 270/58.07
7,669,843 B2 * 3/2010 Milillo et al. ..... 270/58.09
8,042,808 B2 * 10/2011 Sato ..... 271/298
2012/0275839 A1 11/2012 Kushida et al.
2012/0288310 A1 11/2012 Kamiya et al.
2012/0313317 A1 12/2012 Gamo et al.
2012/0319346 A1 12/2012 Iwata et al.
2013/0026695 A1 1/2013 Tokuma

* cited by examiner

SHEET PROCESSING APPARATUS WITH TWO IMAGE FORMING DEVICES

BACKGROUND OF THE INVENTION

1. Field of the Invention

The present invention relates to a sheet processing apparatus that processes a sheet and an image forming apparatus including the sheet processing apparatus.

2. Description of the Related Art

In the related art, an image forming system in which a common sheet processing apparatus is capable of receiving a sheet from two image forming apparatuses is suggested (see Japanese Patent Laid-Open No. 2004-093984).

The image forming system receives a sheet conveyed from one of the image forming apparatuses through one of inlets of the common sheet processing apparatus and discharges the sheet to a processing tray to be stacked. Further, the image forming system receives a sheet conveyed from the other image forming apparatus through the other inlet of the common sheet processing apparatus and discharges the sheet to the processing tray to be stacked.

Therefore, since a sheet from both image forming apparatuses can be received by the common sheet processing apparatus, one sheet processing apparatus is only required for two image forming apparatuses. Thus, the cost is reduced and the space is saved.

However, in the above-mentioned related art, while the sheet conveyed from one of the image forming apparatuses is discharged and stacked onto the processing tray, the discharging and stacking of the sheet conveyed from the other image forming apparatus to the processing tray need to wait until the sheet processing is completed. Therefore, even though a user has two image forming apparatuses, the sheet processing has a productivity corresponding to one image processing apparatus. Thus, the productivity for entire system is significantly lowered.

As a method for solving the above-mentioned problem, a method for discharging and stacking sheets conveyed from two image forming apparatuses onto a processing tray of a common sheet processing apparatus is suggested. However, if timings to discharge a sheet to the processing tray as illustrated in FIGS. 9A and 18A overlap, leading edges of opposing two sheets which are conveyed from the two image forming apparatuses collide with each other and is jammed.

SUMMARY OF THE INVENTION

It is desirable to improve the productivity of the entire system by enabling sheets from two image forming apparatuses to be simultaneously discharged to a common sheet processing apparatus.

A sheet processing apparatus that stacks sheets received from two image forming apparatuses in a processing tray and selectively processes a sheet bundle having a plurality of stacked sheets includes a first discharging portion that discharges a sheet received from one of the two image forming apparatuses to the processing tray; a second discharging portion that is disposed so as to be opposite to the first discharging portion with respect to the processing tray and discharges a sheet received from the other image forming apparatus of the two image forming apparatuses to the processing tray; and a controller that controls the first discharging portion and the second discharging portion. The first discharging portion and the second discharging portion are disposed opposite each other so that the sheets discharged to the processing tray are stacked on top of each other. When the sheets are continuously discharged by the first discharging portion and the second discharging portion to the processing tray, the controller controls a timing when the sheets are discharged by the first discharging portion and the second discharging portion to the processing tray such that a leading edge of the sheet discharged by one of the discharging portions abuts on a sheet surface of the sheet discharged by the other discharging portion.

According to the present invention, at a timing when leading edges of two sheets which are discharged to be opposite to each other do not interfere with each other, it is possible to discharge the sheets to the common processing tray, prevent the leading edges of the sheets from colliding with each other to be jammed, and improve the productivity of the entire system.

Further features of the present invention will become apparent from the following description of exemplary embodiments with reference to the attached drawings.

DESCRIPTION OF THE EMBODIMENTS

Hereinafter, with reference to accompanying drawings, exemplary embodiments of the present invention will be illustratively described in detail. A size, a material, a shape, or a relative arrangement of components described in the following embodiments may be appropriately varied depending on the configuration of an apparatus to which the present invention is applied or various conditions. Therefore, if not specifically described, a scope of the present invention is not limited thereto.

First Embodiment

An image forming system that includes a sheet processing apparatus according to a first embodiment and two image forming apparatuses that supply a sheet to the sheet processing apparatus will be described. Here, a copying machine as an image forming system having a stacker as a common sheet processing apparatus and two image forming apparatuses will be described as an example.

(Image Forming System)

Figure 1:
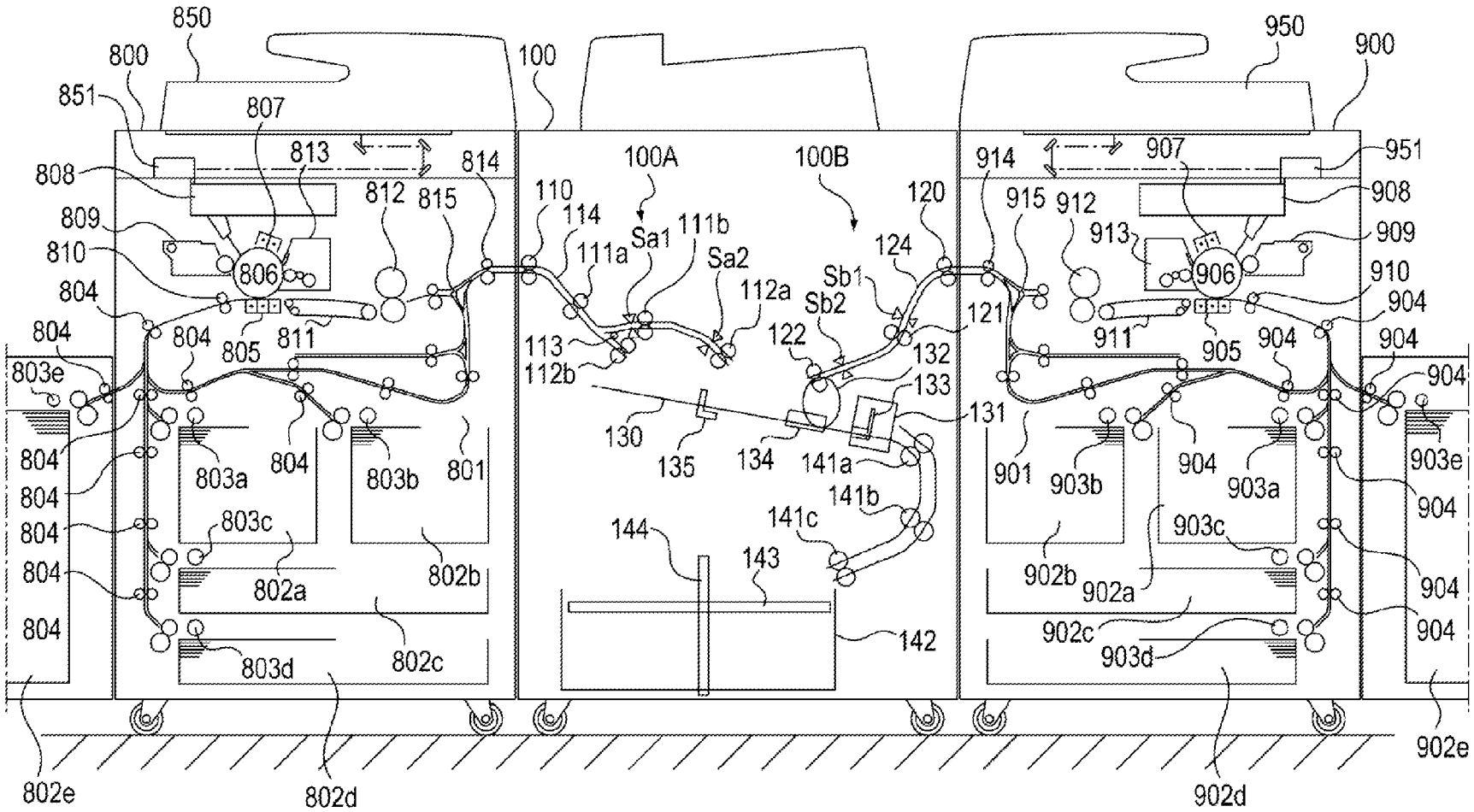
FIG. 1 is a cross-sectional view illustrating a copying machine as an example of an image forming system including two image forming apparatuses and a stacker which is a common sheet processing apparatus.

FIG. 1 is a main cross-sectional view of the image forming system. The image forming system illustrated in FIG. 1 includes a stacker 100 as a sheet processing apparatus, a first image forming apparatus 800, and a second image forming apparatus 900. The first image forming apparatus 800 includes a first automatic document feeding apparatus 850 and a first two-sided reversing apparatus 801 in addition to an image forming portion that forms an image on a sheet. A second image forming apparatus 900 includes a second automatic document feeding apparatus 950 and a second two-sided reversing apparatus 901 in addition to an image forming portion that forms an image on a sheet.

The image forming system operates as follows. The first image forming apparatus and the second image forming apparatus perform the same operation, so that the operation will be described using the first image forming apparatus and the operation of the second image forming apparatus will be omitted.

Sheets set in sheet cassettes 802*a* to 802*e* are conveyed to a registration roller 810 by feed rollers 803*a* to 803*e* and a pair of conveying rollers 804. On a photosensitive drum 806 that configures the image forming portion, a process in which an electrostatic latent image is changed into a visible image by a primary charger 807, a development device 809, and an exposure portion 808 is performed. Accordingly, a copying toner image corresponding to digital document data is formed on the photosensitive drum 806. Further, the digital document data may be digital original data obtained by reading out an original document sent from the automatic document feeding apparatus 850 in advance by an image reading apparatus 851 or data sent from a computer through an external I/F.

The sheet which is conveyed to the registration roller 810 is conveyed to a transferring portion by the registration roller 810 at a timing when a leading edge of the sheet and a leading edge of a toner image of the photosensitive drum 806 are matched with each other. A transfer bias is applied to the sheet that is conveyed to the transferring portion by a transfer separating charger 805 so that a toner image on the photosensitive drum 806 is transferred onto the sheet.

The sheet onto which the toner image is transferred is conveyed to a fixing device 812 by a conveyance belt 811 and sandwiched between a heating roller and a pressure roller so that the toner image is heat-fixed. In this case, extraneous substances such as remaining toner which is not transferred onto the sheet and attached onto the photosensitive drum 806 are scraped off by a blade of a cleaning device 813 and the surface of the photosensitive drum 806 is cleaned to be prepared for a next image forming process.

The sheet on which the toner image is fixed is discharged to a stacker 100 as a sheet processing apparatus by a discharge roller 814 as it is or conveyed to the two-sided reversing apparatus 801 by a switching member 815 to perform image forming again.

<System Block Diagram>

Figure 13:
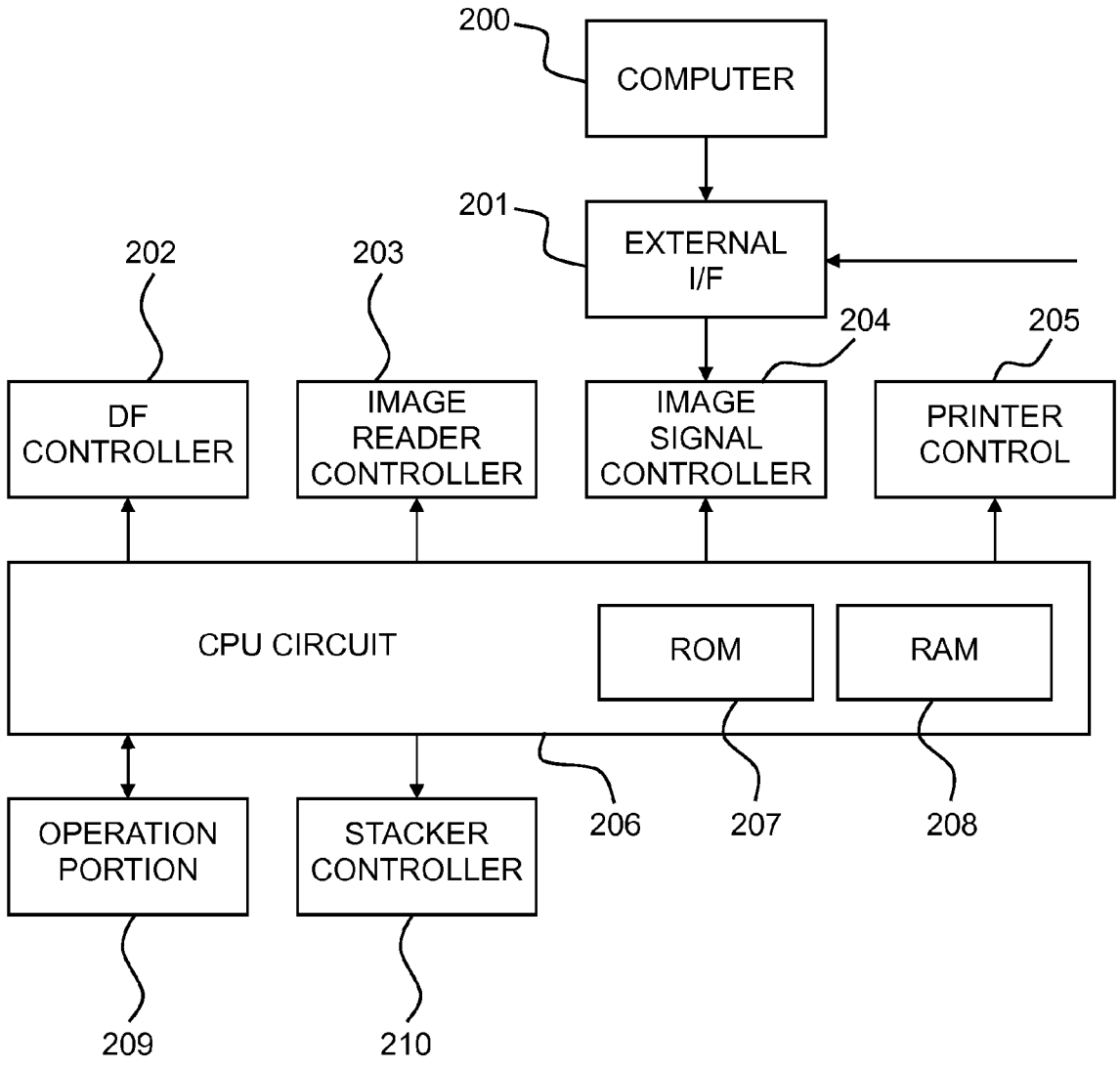
FIG. 13 is a control block diagram of a copying machine according to the first embodiment.

Next, a configuration of a controller that controls the entire image forming system will be described with reference to FIG. 13. FIG. 13 is a block diagram illustrating a configuration a controller that controls the entire image forming system illustrated in FIG. 1.

The controller, as illustrated in FIG. 13, includes a CPU circuit 206. The CPU circuit 206 includes a CPU (not illustrated), a ROM 207, and a RAM 208 therein. The CPU circuit 206 generally controls blocks 202, 209, 203, 204, 201, 205, and 210 by a control program stored in the ROM 207. The RAM 208 temporally stores control data and is used as a working area of an arithmetic processing according to the control.

A DF (document feeding) controller 202 controls to drive the automatic document feeding apparatuses 850 and 950 based on an instruction from the CPU circuit 206. An image reader controller 203 controls to drive a scanner portion and an image sensor in image reading apparatuses 851 and 951 and transmits an analog image signal which is output from the image sensor to an image signal controller 204.

The image signal controller 204 converts an analog image signal from the image sensor into a digital signal and then performs the processings and converts the digital signal into a video signal to output the video signal to a printer controller 205. Further, the image signal controller 204 performs various processings on a digital image signal which is input from a computer 200 through an external I/F 201 and converts the digital image signal into a video signal to output the video signal to the printer controller 205. The processing operation by the image signal controller 204 is controlled by the CPU circuit 206. The printer controller 205 drives an exposure controlling portion based on the input video signal.

An operation portion 209 includes a plurality of keys that set various functions for forming an image and a display that displays information indicating a setting state. The operation portion 209 outputs a key signal corresponding to the manipulation of the key to the CPU circuit 206 and displays corresponding information on the display based on the signal from the CPU circuit 206.

A stacker controller 210 is mounted in the stacker 100 and exchanges information with the CPU circuit 206 to control to drive the entire stacker. Further, like the above-described controller, the stacker controller 210, which will be described below, has a CPU 52, a ROM 51, and a RAM 53 (see FIG. 14). The CPU 52 generally controls blocks of the stacker by a control program stored in the ROM 51. The RAM 53 temporally stores control data and is used as a working area of an arithmetic processing according to the control. Further, the stacker controller 210, which will be described below, controls the drive of drive motors M1, M2, M3, and M4 as driving portions based on detection information of sensors Sa1, Sa2, Sb1, and Sb2 as detecting portions.

<Stacker>

Figure 2:
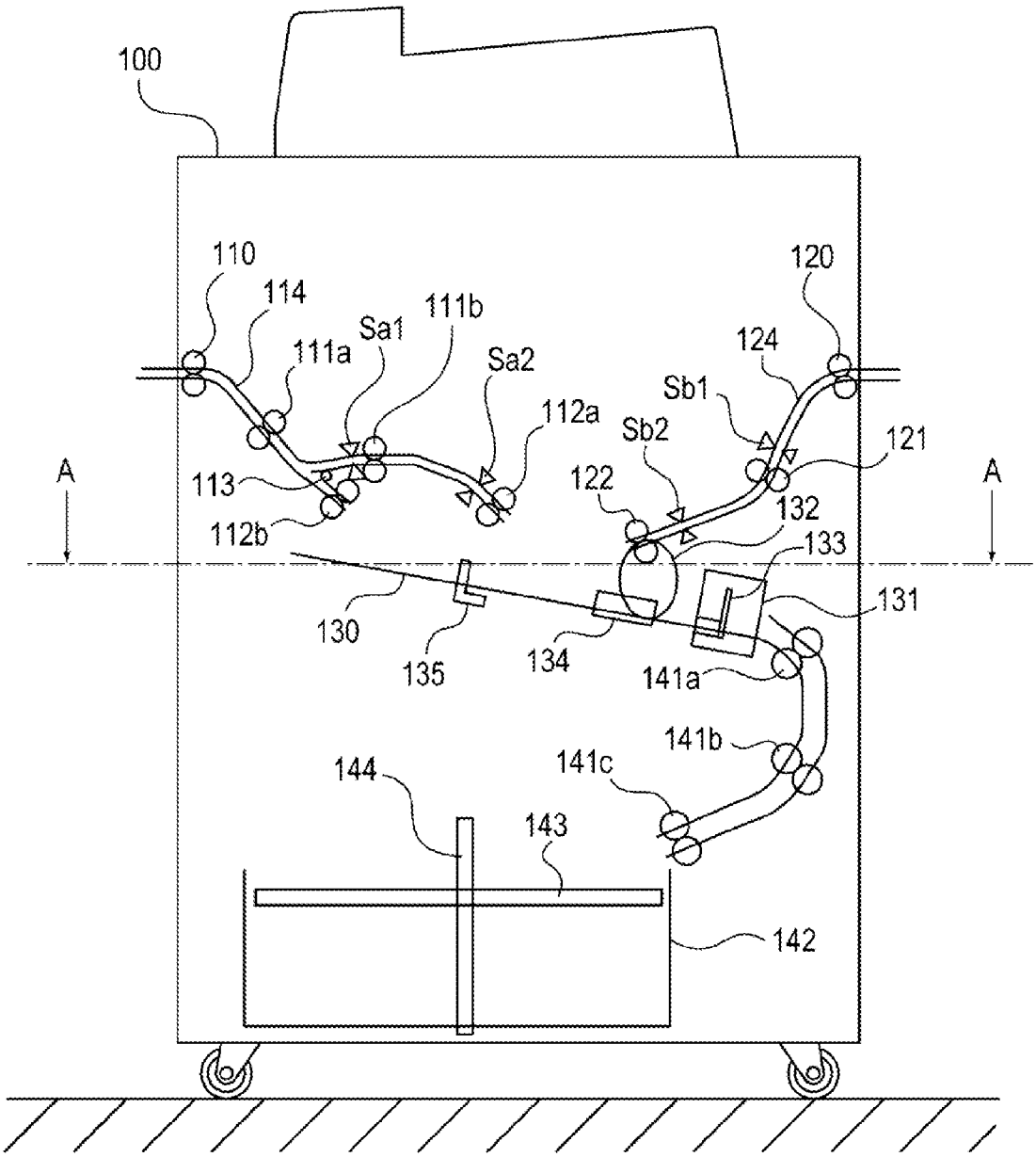
FIG. 2 is a cross-sectional view illustrating a stacker according to a first embodiment.

A configuration of the stacker 100 will be described with reference to FIGS. 1 and 2. The stacker 100 is a sheet processing apparatus which is capable of receiving a sheet from the first image forming apparatus 800 and the second image forming apparatus 900 to discharge, process, and stack the sheet.

The stacker 100 discharges the sheet received from each image forming apparatus to a common processing tray 130 by inlet rollers 110 and 120, conveying rollers 111 and 121, and discharge rollers 112 and 122. A sheet bundle having a plurality of sheets discharged and stacked into the processing tray 130 is selectively processed. The sheet which is sent to the processing tray 130 is aligned by an aligning belt 132, an abutting plate 133, and an aligning plate 134, and a staple processing is performed thereon by a stapler 131. The sheet is discharged and stacked onto a stack tray 143 by bundle discharging rollers 141*a*, 141*b*, and 141*c*.

The stacker 100 includes a first discharging portion 100A that discharges the sheet received from the first image forming apparatus 800 to the processing tray 130 and a second discharging portion 100B that discharges the sheet received from the second image forming apparatus 900 to the processing tray 130. The first discharging portion 100A and the second discharging portion 100B are controlled by the stacker controller 210 as a controller. The first discharging portion 100A and the second discharging portion 100B are disposed opposite each other so that the sheets discharged to the processing tray 130 are stacked on top of each other. Here, the first discharging portion 100A discharges a sheet received by the inlet roller 110 to the processing tray 130 by a conveying roller 111 and a discharge roller 112. The second discharging portion 100B discharges a sheet received by the inlet roller 120 to the processing tray 130 by a conveying roller 121 and a discharge roller 122.

Next, an outline of a configuration and an operation of the stacker 100 will be described with reference to block diagrams of FIGS. 1 to 5, and 14, and a flowchart of FIG. 15.

First, an operation of discharging and aligning a sheet P1 on which an image is formed by the first image forming apparatus 800 onto the processing tray 130 of the stacker 100 will be described.

Figure 15:
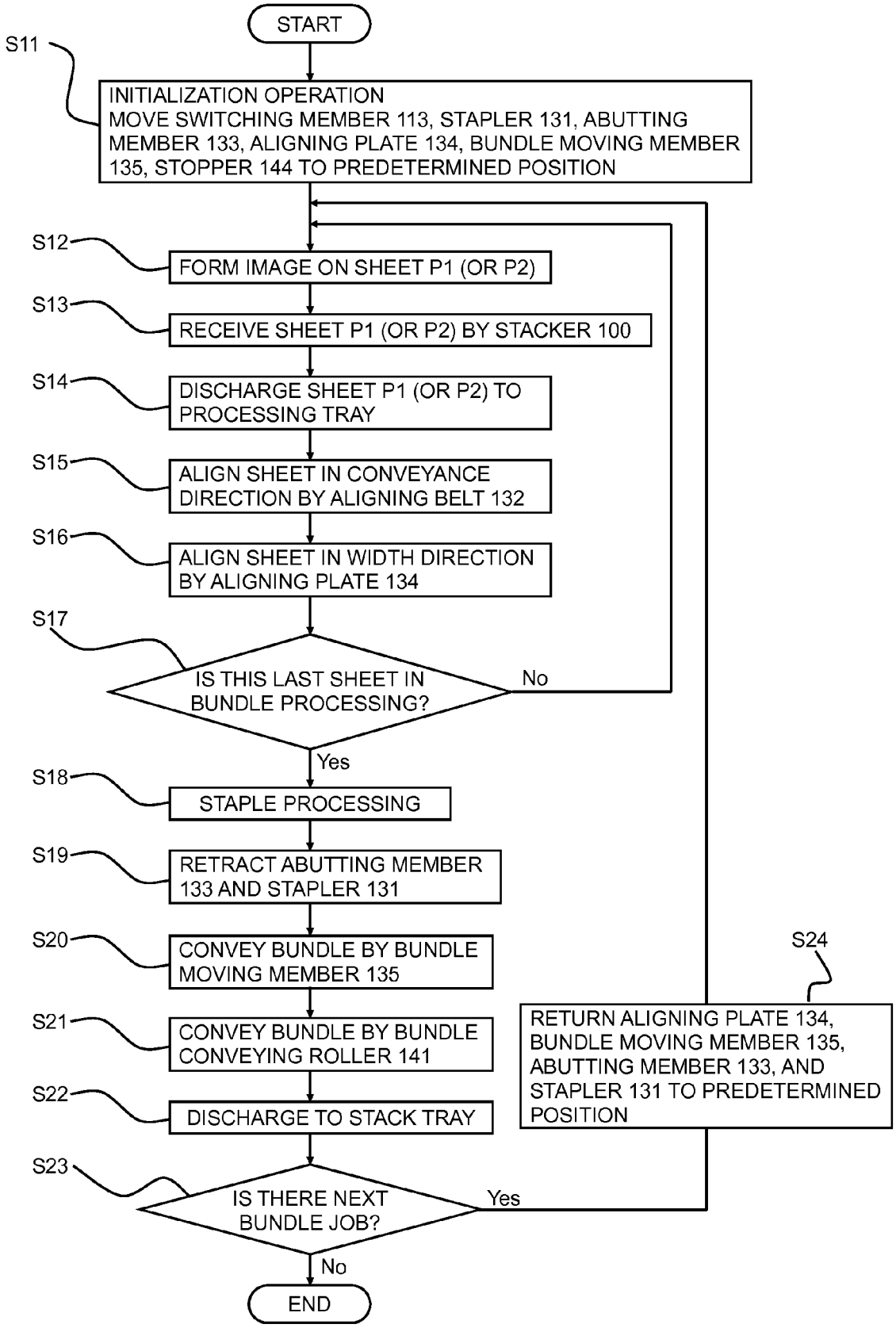
FIG. 15 is a flowchart illustrating an operation of the stacker according to the first embodiment.

Based on information of a sheet received from the image forming apparatus, the stacker controller 210 controls a switching member 113, the abutting plate 133, the aligning plate 134, a bundle moving member 135, and a stopper 144 to be moved to a predetermined position and performs an initializing operation (S11 in FIG. 15).

Figure 14:
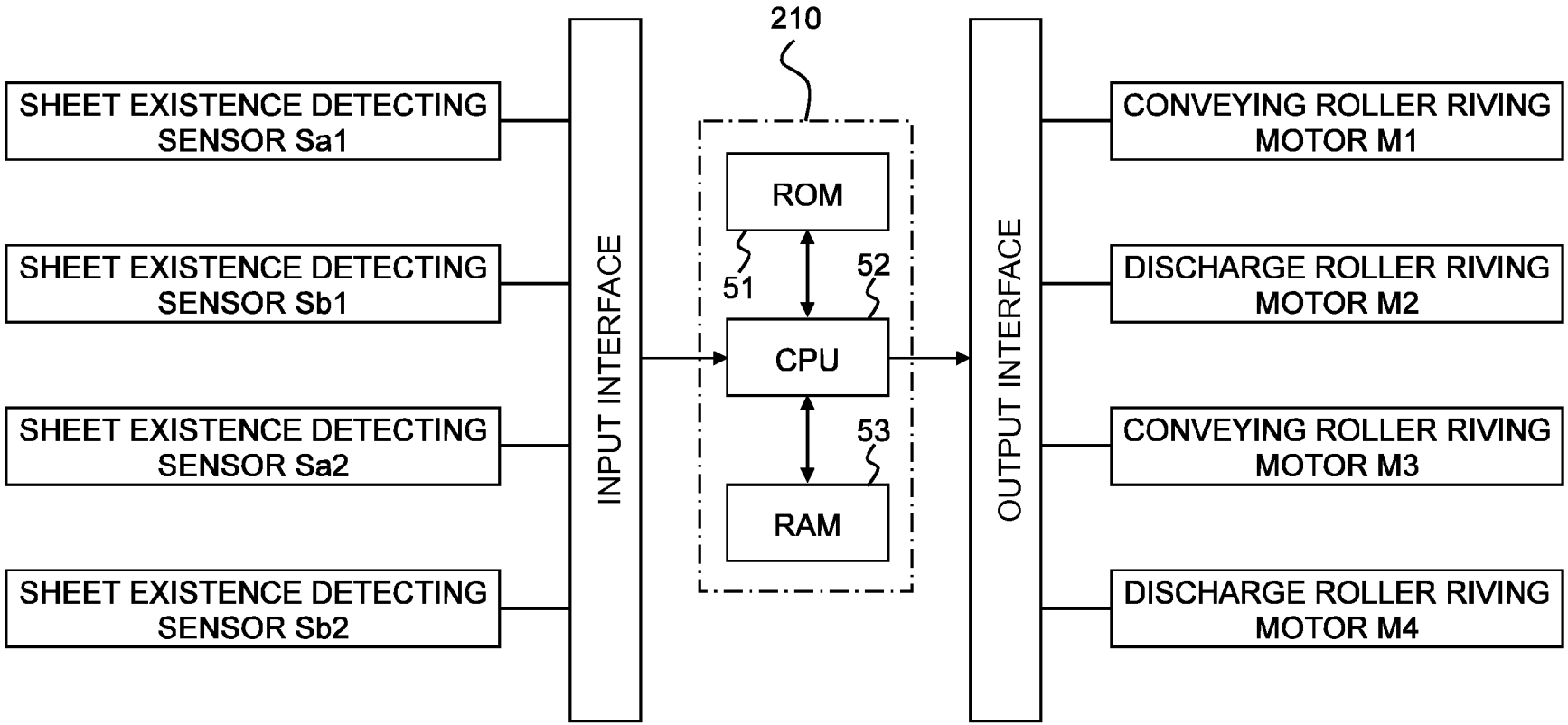
FIG. 14 is a control block diagram of the stacker according to the first embodiment.

The sheet P1 on which an image is formed by the first image forming apparatus 800 is received from the first inlet roller 110. Thereafter, the sheet P1 passes through a first conveyance path 114 by the first conveying roller 111, a conveyance route of the sheet P1 is switched by the switching member 113 that switches a conveyance path, and then the sheet P1 is discharged to the processing tray 130 by the discharge roller 112 (S12 to S14 of FIG. 15). In this case, for example, a sheet, which is short in a discharging direction like an A4 size sheet, is discharged to the processing tray 130 through the discharge roller 112*a* and a sheet, which is long in a discharging direction like an A3 size sheet, is discharged through the discharge roller 112*b*. The conveying roller 111 and the discharge roller 112 are driven by a conveying roller driving motor M1 and a discharge roller driving motor M2, respectively, to be rotated (see FIG. 14). The driving motors M1 and M2 are controlled by the stacker controller 210 as illustrated in FIG. 14.

Figure 3A:
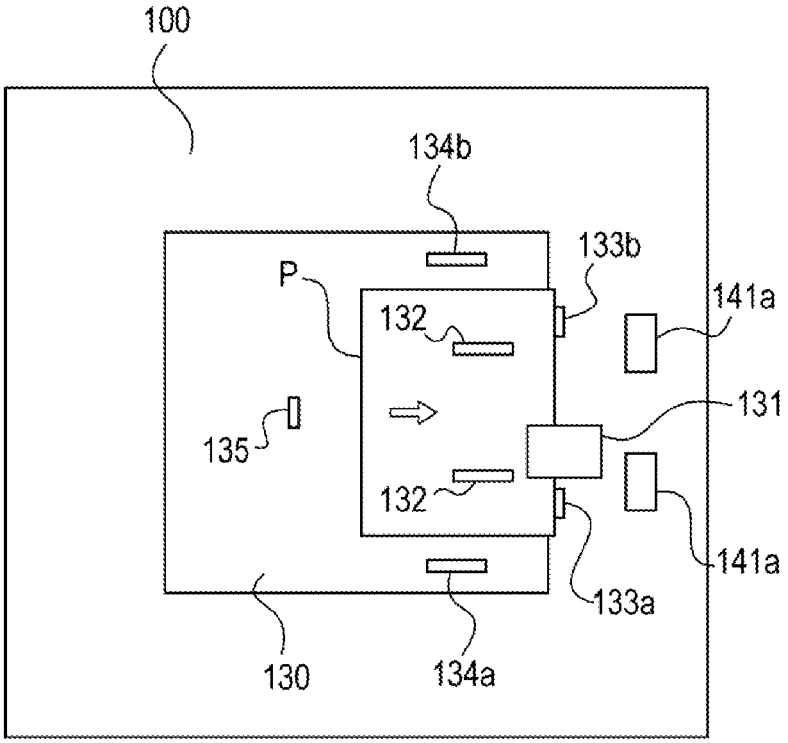
FIGS. 3A and 3B are operation illustration diagrams illustrating the stacker according to the first embodiment.
Figure 3B:
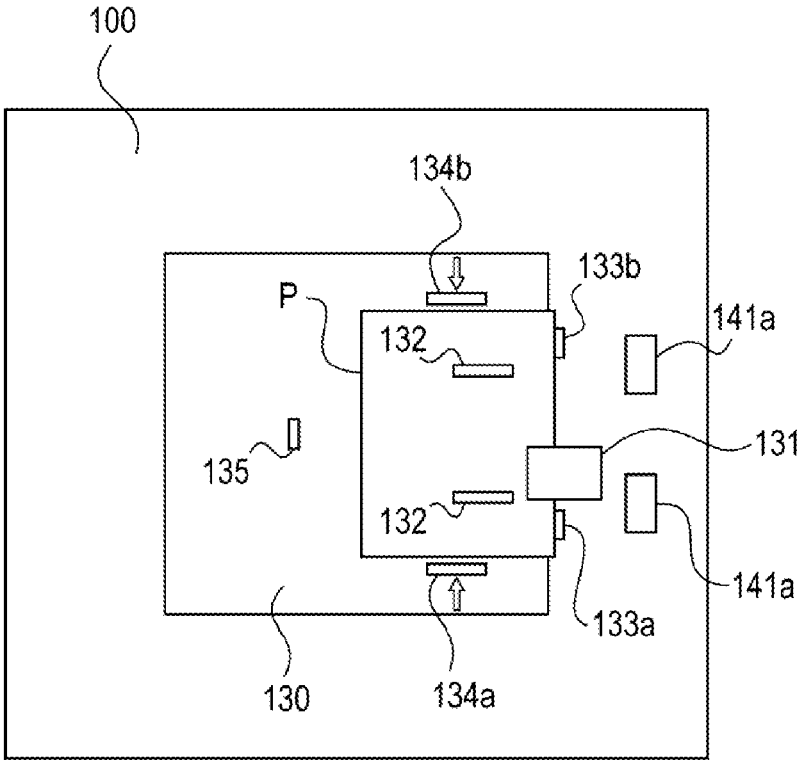

An aligning operation in the discharging direction of the sheet P1 discharged to the processing tray will be described with reference to FIG. 3A. The aligning belt 132 that aligns the discharging direction is disposed on the discharge roller 112 and is also driven by the discharge roller driving motor M2. The sheet P1 which is sent from the discharge roller 112 to the aligning belt 132 is conveyed by the aligning belt 132 and abuts with the abutting plate 133. After abutting, the aligning belt 132 is conveyed with a slight pressure with respect to the sheet P1, and therefore a conveyance force is applied in a state where the sheet P1 slides on the aligning belt 132 while abutting with the abutting plate 133 to align the discharging direction (S15 of FIG. 15).

An operation of aligning a width direction that is perpendicular to the discharging direction which is performed after aligning the discharging direction as described above will be described with reference to FIG. 3B. A position of the aligning plate 134 is detected by an aligning plate position detecting sensor which is not illustrated and is moved by an aligning plate moving motor which is not illustrated. Before starting a job, information of the sheet P1 is transmitted to the stacker controller 210 and the aligning plate 134 waits the outside at a position that departs from a center by half a width of the sheet P1 (a size of a width direction). Therefore, as described above, after the sheet P1 abuts with the abutting plate 133, the aligning plate 134 is closed by a width which is equal to a width of the sheet so that a width direction of the sheet P1 is also aligned in a predetermined position (S16 of FIG. 15).

As described above, the sheet P1 conveyed from the first image forming apparatus 800 is discharged onto the processing tray 130 to be aligned in the discharging direction and the width direction.

Next, an operation for discharging and aligning a sheet P2 on which an image is formed by the second image forming apparatus 900 to the processing tray 130 of the stacker 100 will be described.

The sheet P2 on which an image is formed by the second image forming apparatus 900 is received by a second inlet roller 120. Thereafter, the sheet P2 passes through a second conveyance path 124 by the second conveying roller 121 and then the sheet P2 is discharged to the processing tray 130 by the discharge roller 122 (S12 to S14 of FIG. 15). The conveying roller 121 and the discharge roller 122 are driven by a conveying roller driving motor M3 and a discharge roller driving motor M4, respectively, to be rotated (see FIG. 14). The driving motors M3 and M4 are controlled by the stacker controller 210 as illustrated in FIG. 14.

The sheet P2 which is discharged by the discharge roller 122 to the processing tray 130 is led into a nip portion of the aligning belt 132 by declining the processing tray 130. Thereafter, the sheet P2 is conveyed and aligned by the aligning belt 132 (S15 and S16 of FIG. 15). In this case, the conveying and aligning operation is performed similarly to the conveying and aligning operation for the above-mentioned sheet P1.

As described above, the sheet P1 from the first image forming apparatus 800 and the sheet P2 from the second image forming apparatus 900 are sent to the common stacker 100 and alternately and sequentially laminated on the processing tray 130 to be aligned. If a last sheet of the sheet bundle is discharged and aligned into the processing tray 130 (S17 of FIG. 15), the staple processing is performed by the stapler 131 (S18 of FIG. 15).

Figure 4A:
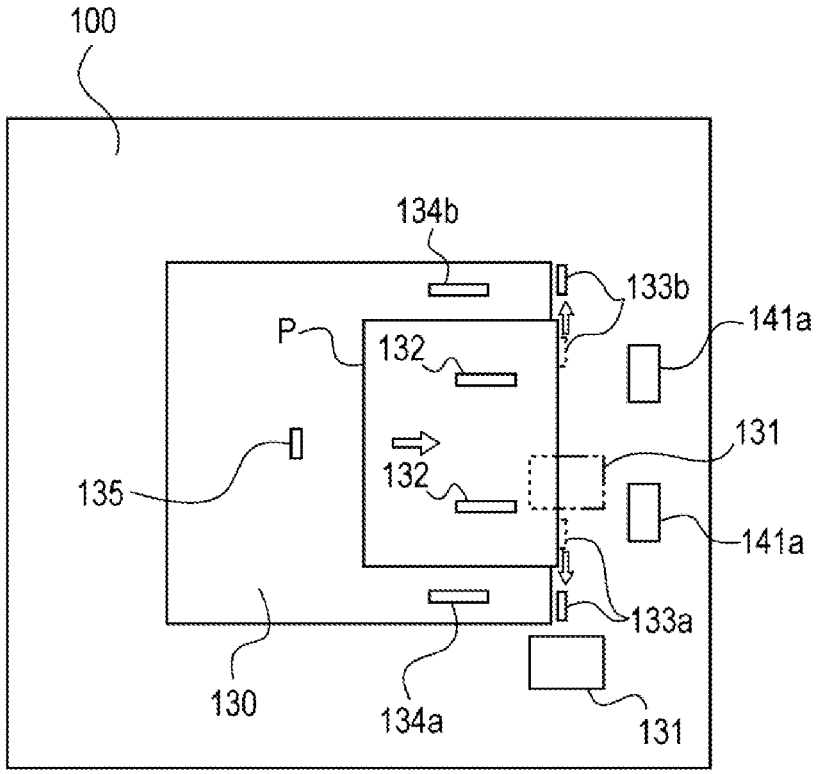
FIGS. 4A and 4B are operation illustration diagrams illustrating the stacker according to the first embodiment.
Figure 4B:
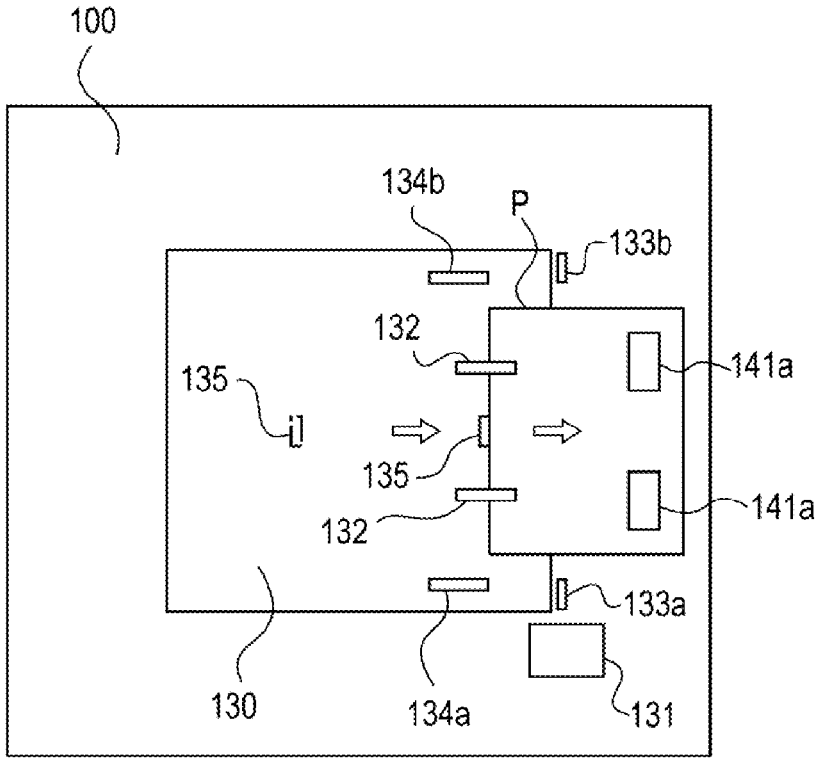

Thereafter, as illustrated in FIG. 4A, the abutting plate 133 and the stapler 131 are retracted to the outside of the sheet conveyance region (vertical direction of FIG. 4A) (S19 of FIG. 15). Therefore, as illustrated in FIG. 4B, a stapled sheet bundle P is conveyed to the nip portion of the bundle discharging roller 141*a* by the bundle moving member 135 (S20 of FIG. 15). The sheet bundle P is discharged and stacked onto a stack box 142 by the bundle discharging rollers 141*b* and 141*c* (S21 and S22 of FIG. 15).

The stacker controller 210 discharges and stacks the sheet bundle P into the stack box 142 and then checks whether there is a job for a next sheet bundle (S23 of FIG. 15). If there is no job, the operation is completed. If there is a job, similarly to the above-mentioned initializing operation, the stacker controller 210 controls to move the abutting plate 133, the aligning plate 134, the bundle moving member 135, and the stapler 131 to a predetermined position (S24 of FIG. 15) and is prepared for the next job.

Figure 5A:
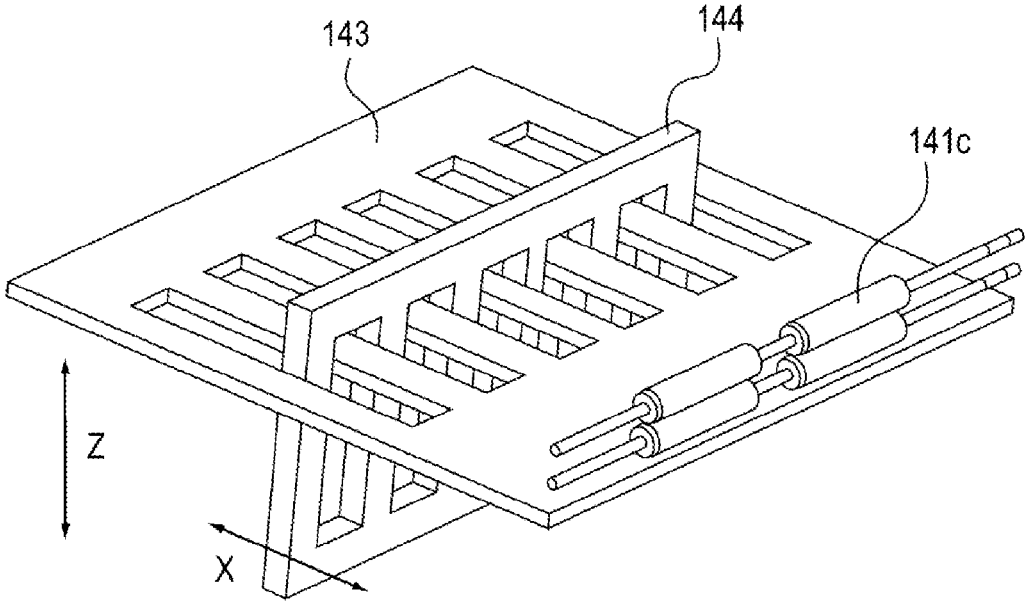
FIGS. 5A and 5B are operation illustration diagrams illustrating the stacker according to the first embodiment.
Figure 5B:
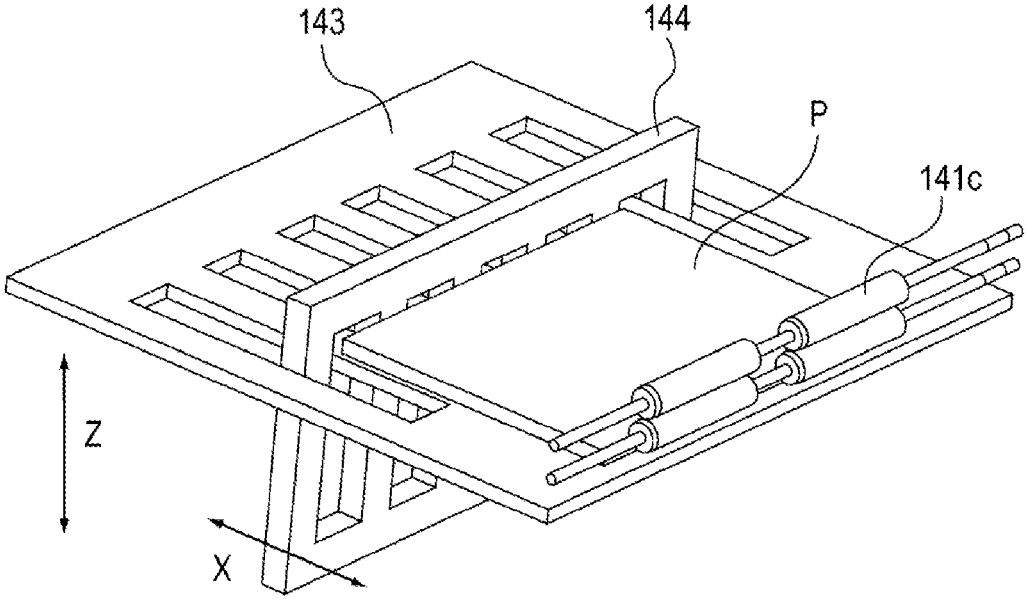

In the stack box 142, a stack tray 143 and a stopper 144 are disposed. The stack tray 143 is disposed so as to be lifted and lowered vertically (in an arrow Z direction of FIGS. 5A and 5B) by a stack tray moving motor which is not illustrated, and the stopper 144 is disposed so as to be moved horizontally (in an arrow X direction of FIGS. 5A and 5B) by a stopper moving motor which is not illustrated. The stack tray 143 and the stopper 144 are formed to have a dentate shape as illustrated in FIG. 5A and freely move vertically (in the arrow Z direction of FIGS. 5A and 5B) and horizontally (in the arrow X direction of FIGS. 5A and 5B). The stopper 144 moves to an appropriate position according to a length of the discharging direction of the sheet before the job, and waits in that position without moving until the job is completed. In the meantime, the stack tray 143 frequently detects a sheet height by a sheet height detecting portion such as an optical sheet height detecting sensor. If the sheet is higher than a predetermined height, the stack tray 143 is lowered by a predetermined height. By repeating the sheet detecting and lowering operation between the jobs, a position of the bundle discharging roller 141*c* that discharges the sheet bundle P to the stack tray 143 and a relative height of the stack tray 143 are controlled to be constant. As a result of the above operation, as illustrated in FIG. 5B, the sheet bundle P is in a stacked state.

Continuously, an operation that continuously and alternately stacks the sheets P1 and P2 conveyed from the first image forming apparatus 800 and the second image forming apparatus 900 to the processing tray 130 will be described in detail with reference to drawings of FIGS. 6 to 12, and a flowchart of FIG. 16.

The stacker 100 includes sensors Sa1 and Sa2 as a first detecting portion that detects a position of the sheet P1 from the first image forming apparatus 800 and sensors Sb1 and Sb2 as a second detecting portion that detects a position of the sheet P2 from the second image forming apparatus 900. The stacker controller 210 controls as follows based on information on the positions of the sheets detected by the sensors Sa1, Sa2, Sb1, and Sb2.

Figure 16:
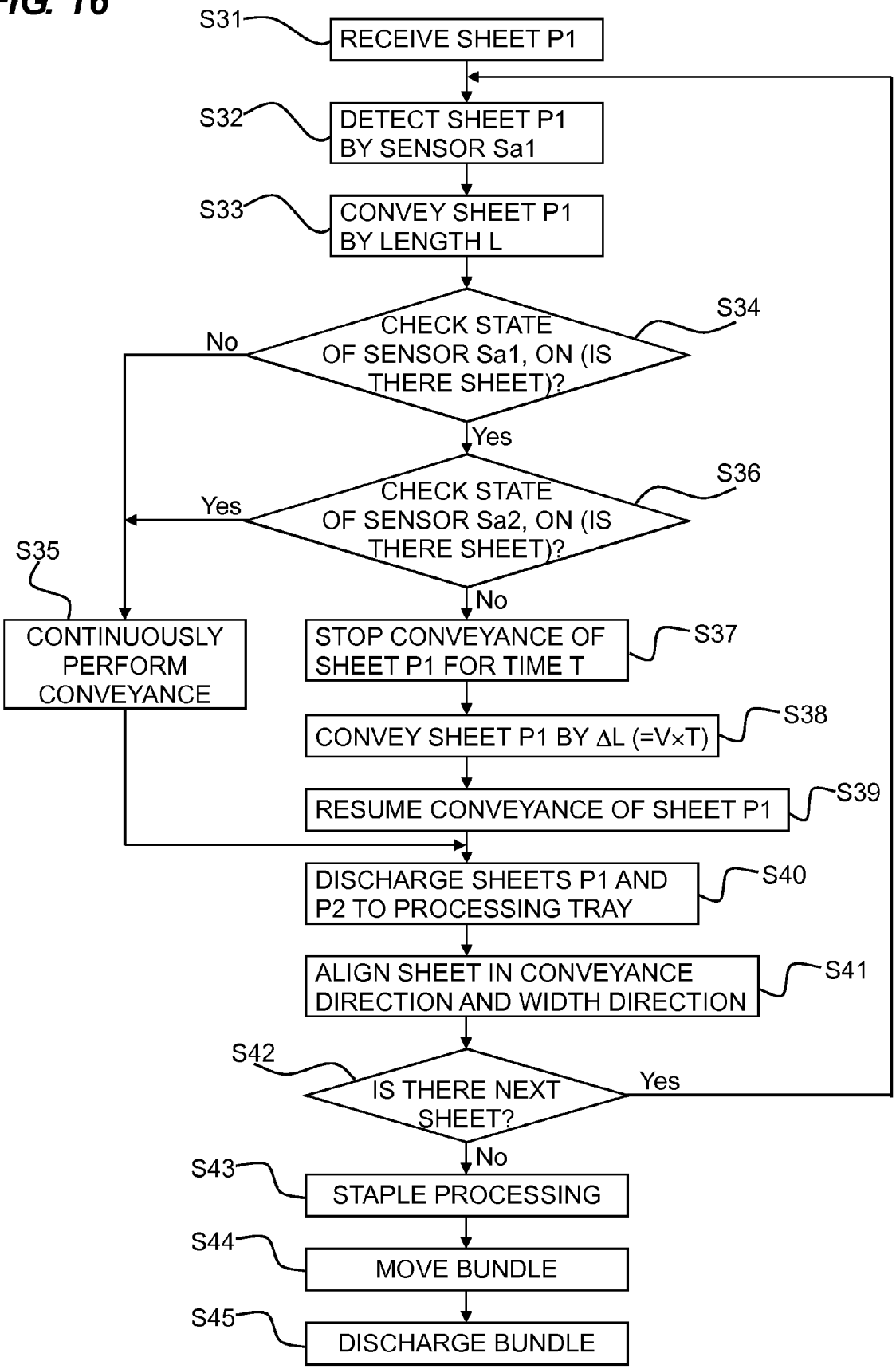
FIG. 16 is a flowchart illustrating an operation of the stacker according to the first embodiment.

First, the stacker 100 receives the sheet P1 conveyed from the first image forming apparatus 800 (S31 of FIG. 16). The received sheet P1 is detected by the sensor Sa1 that detects the existence of the sheet P1 (S32 of FIG. 16) and is conveyed by a predetermined length L to reach a middle point between the sensors Sa1 and Sa2 (S33 of FIG. 16).

Figure 6A:
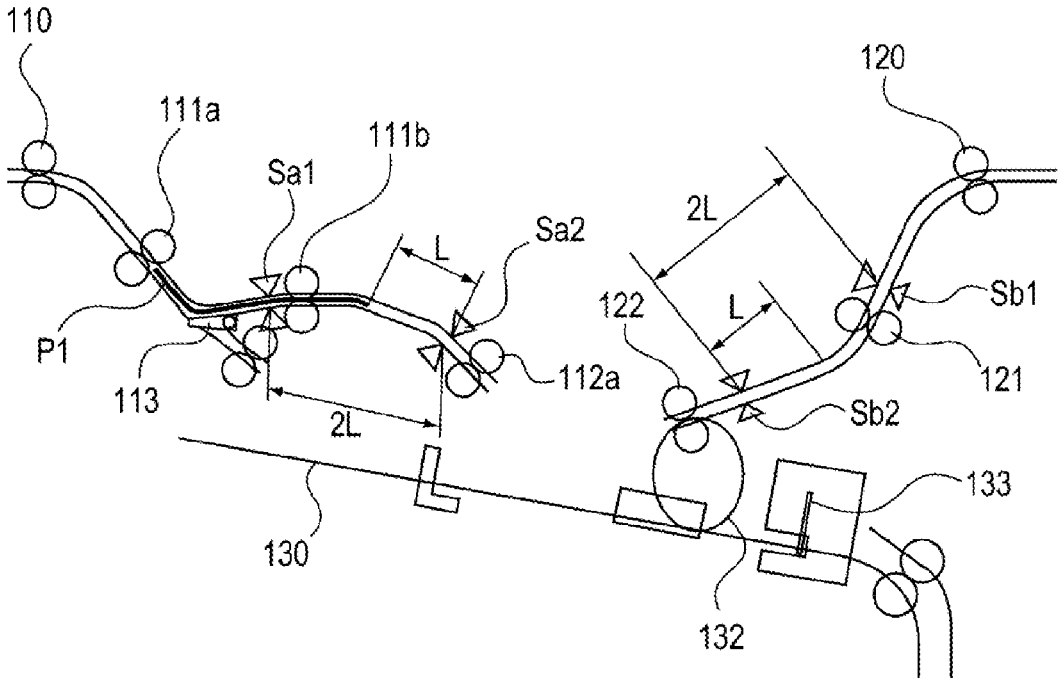
FIGS. 6A and 6B are operation illustration diagrams illustrating the stacker according to the first embodiment.
Figure 6B:
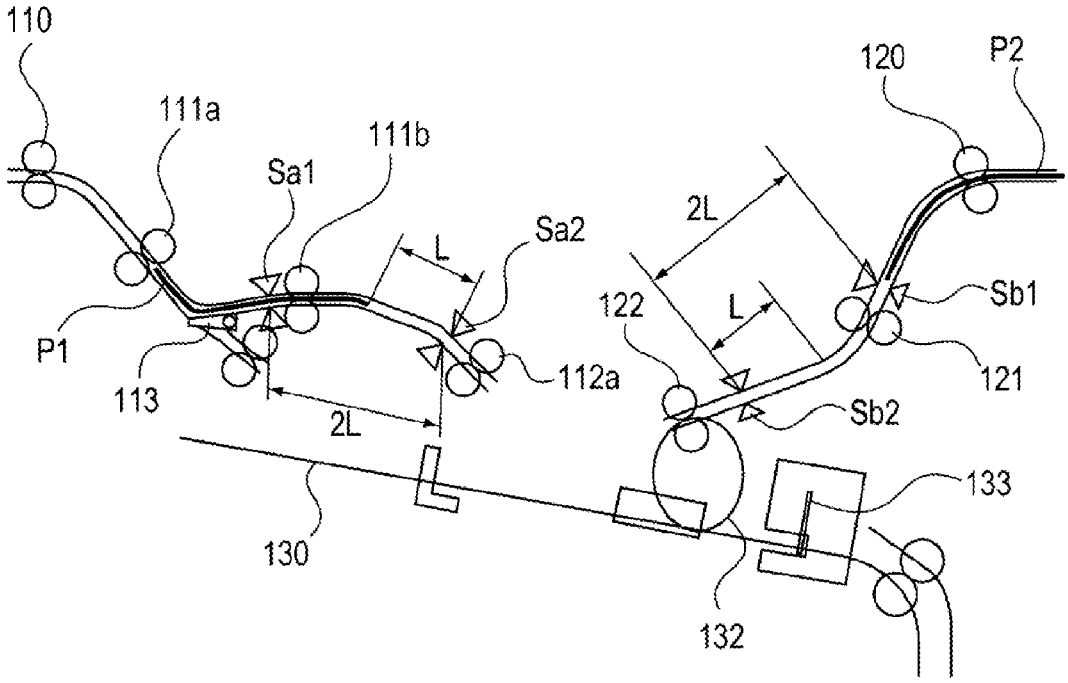

As illustrated in FIG. 6A, at an instant when the received sheet P1 reaches the middle point between the sensors Sa1 and Sa2 (S32 and S33 of FIG. 16), the stacker controller 210 checks the state of the sensor Sb1 that detects the existence of the sheet P2 (S34 of FIG. 16). Therefore, at this instant, if the sensor Sb1 is off (no sheet state) as illustrated in FIG. 6B, the sheet P1 is continuously conveyed (S35 of FIG. 16). In contrast, if the sensor Sb1 is on (sheet existing state), the state of the sensor Sb2 is continuously checked (S36 of FIG. 16).

Figure 7A:
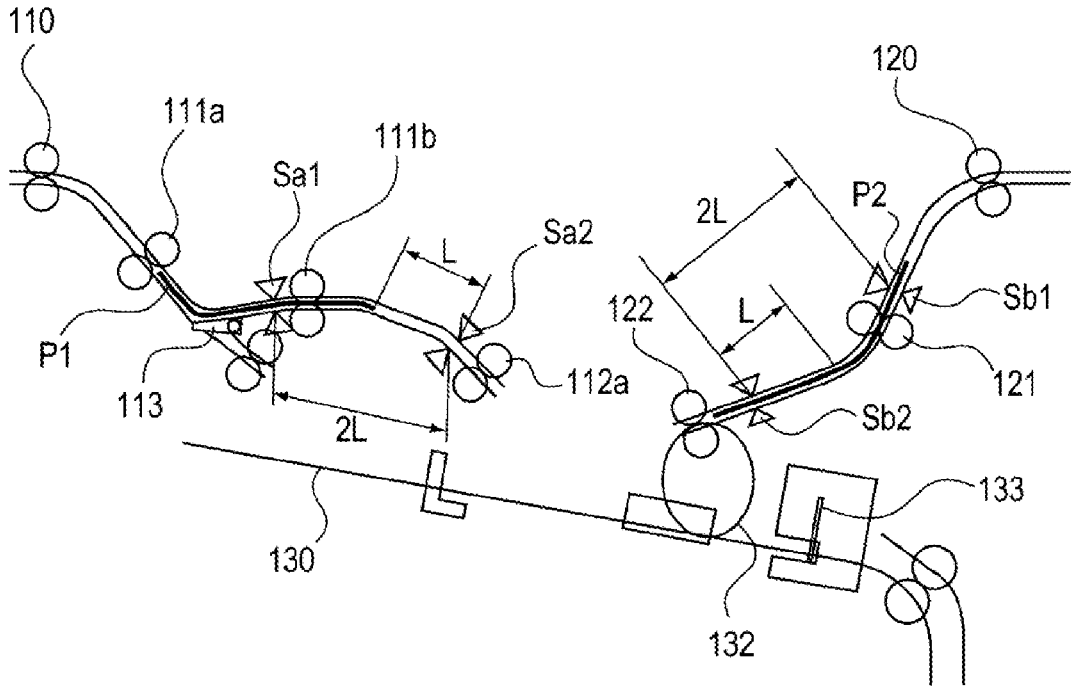
FIGS. 7A and 7B are operation illustration diagrams illustrating the stacker according to the first embodiment.
Figure 7B:
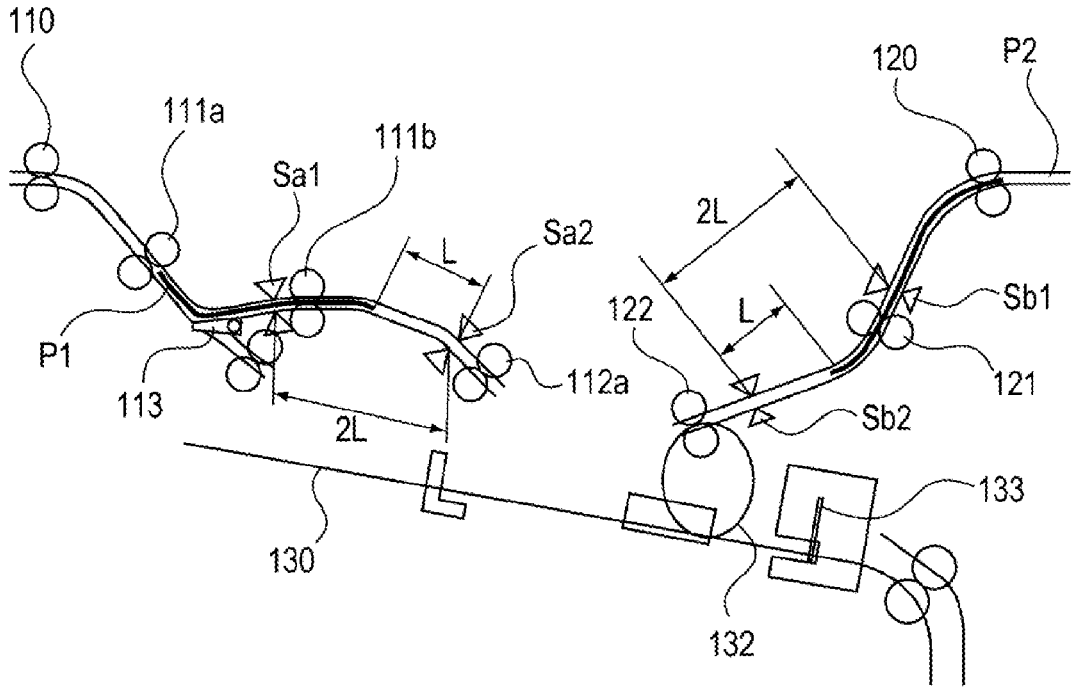

As illustrated in FIG. 7A, if the sensor Sb2 is on, similarly, the sheet P1 is continuously conveyed (S35 of FIG. 16). However, as illustrated in FIG. 7B, if the sensor Sb2 is off, the conveyance of the sheet P1 is stopped for a predetermined time T (S37 of FIG. 16). Since the sheets P1 and P2 are conveyed at the same speed V, while the sheet P1 is stopped for a predetermined time T, the sheet P2 is conveyed by a distance $\Delta L=V\times T$ (S38 of FIG. 16). Accordingly, the sheets P1 and P2 are changed to the state illustrated in FIG. 8A after the predetermined time T elapses from the state illustrated in FIG. 7B.

In this manner, by temporally stopping one of discharging portions (here, the first discharging portion), a leading edge of the sheet P1 discharged from the first discharging portion abuts with a sheet surface of the sheet P2 discharged from the second discharging portion. Accordingly, discharging timings of the sheets by the discharging portions are shifted from each other (see FIG. 8A).

Figure 8A:
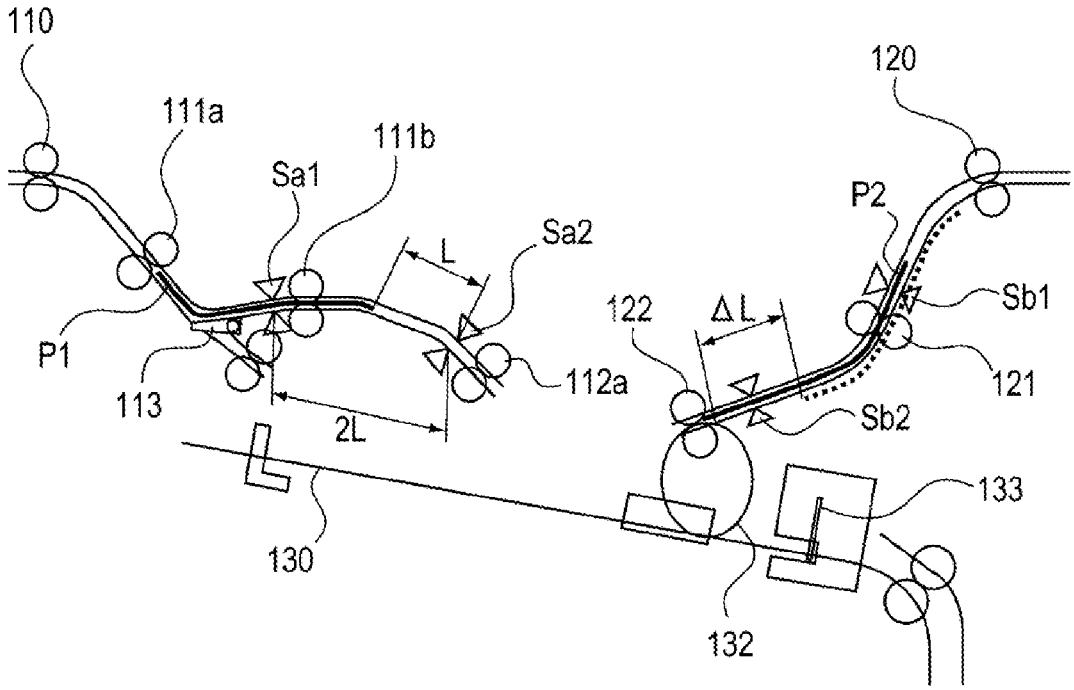
FIGS. 8A and 8B are operation illustration diagrams illustrating the stacker according to the first embodiment.
Figure 8B:
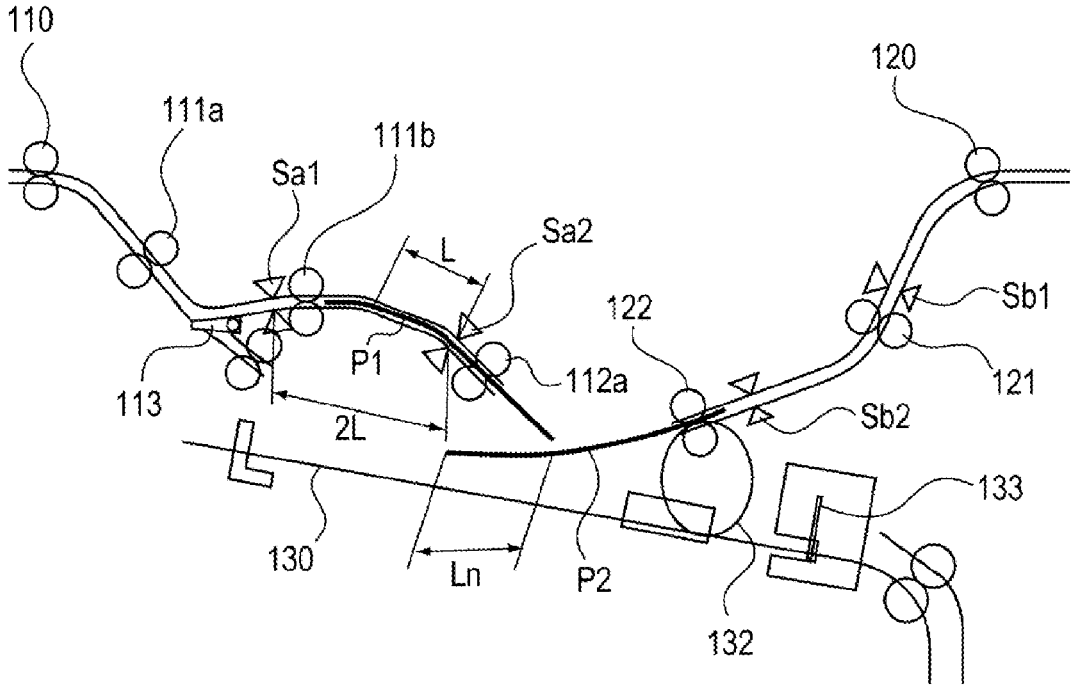
Figure 9A:
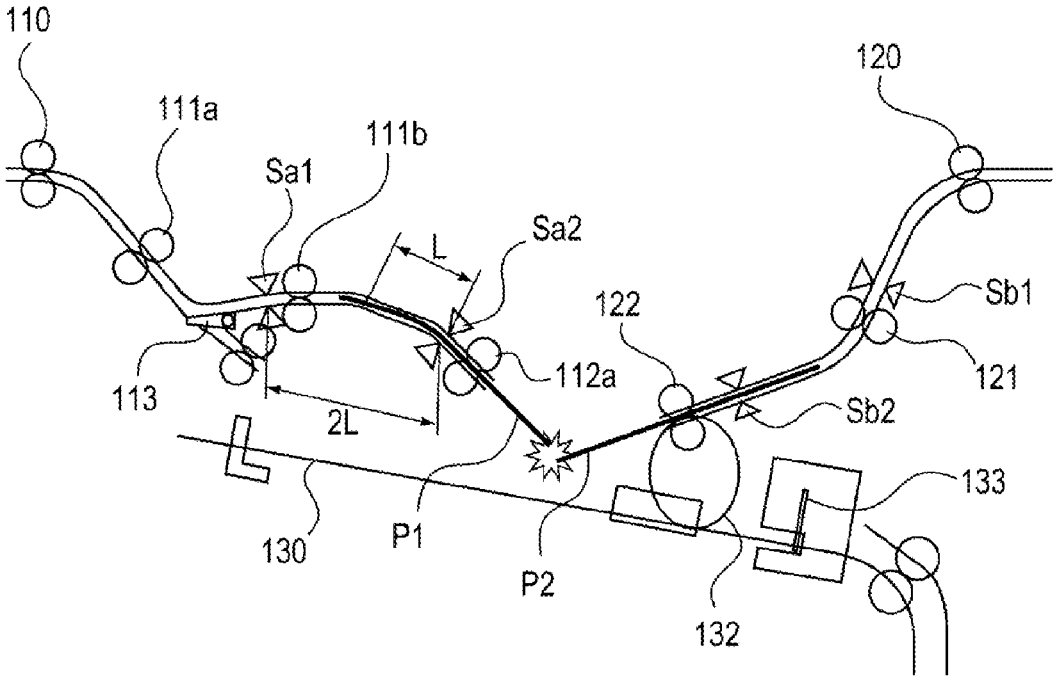
FIG. 9A is an operation illustration diagram illustrating the case when leading edges of sheets collide with each other.

If the conveyance is performed with the positional relationship of the sheets P1 and P2 illustrated in FIG. 8A, as illustrated in FIG. 8B, the leading edge of the sheet P1 and the leading edge of the sheet P2 causes friction (abut) in a state shifted by a length Ln in the discharging direction. Accordingly, without causing conflict of the leading edges of the sheets P1 and P2 with each other, the sheets P1 and P2 may be discharged to the processing tray 130 (S39 and S40 of FIG. 16). As can be seen in FIG. 8B, a nipping line extending from a nipping point of the discharge rollers 122 is perpendicular to a line passing through both rotary centers of the discharge rollers 122 and inclines in a sheet discharge direction downward so as to extend below a horizontal line extending horizontally in the sheet discharge direction from the nipping point. In the state illustrated in FIG. 7B, if the sheets P1 and P2 are continuously conveyed, as illustrated in FIG. 9A, the leading edges of the sheets P1 and P2 conflict on the processing tray to be jammed as described above as the problem to be solved. As illustrated in FIG. 8B, after discharging the sheet to the processing tray 130 in a state where the leading edges of the sheets P1 and P2 are shifted by a length Ln, the alignment, stapling, bundle movement are performed as described above (S41 to S45 of FIG. 16).

As described above, the sheet P1 is controlled so as to be temporally stopped to be discharged to the processing tray 130 in a state shifted from the sheet P2 by a distance $\Delta L=V\times T$. In this case, the distances of the sensors Sa2 and Sb2 from a conflict point of the sheet P1 and the sheet P2 illustrated in FIG. 9A are equal to each other. It is assumed that for a distance 2L between the sensors Sa2 and Sa1 and a distance 2L between the sensors Sb2 and Sb1, $L=L0+\alpha$ and for a temporal stopped period T of the sheet P1, $T=2L/V$. In the meantime, the distance L is a required shift amount L0 (required shift amount of $Ln=L0$) of the leading edge at the time of conflict of the sheet P1 and sheet P2 plus $\alpha$.

Figure 9B:
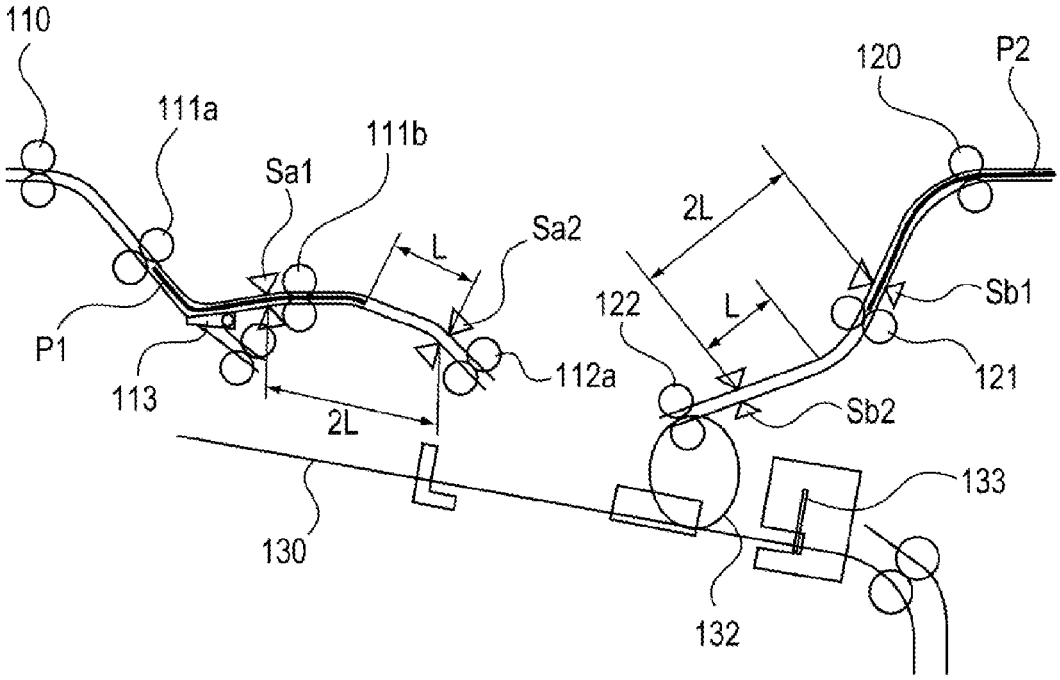
FIG. 9B is an operation illustration diagram illustrating the stacker according to the first embodiment.
Figure 10A:
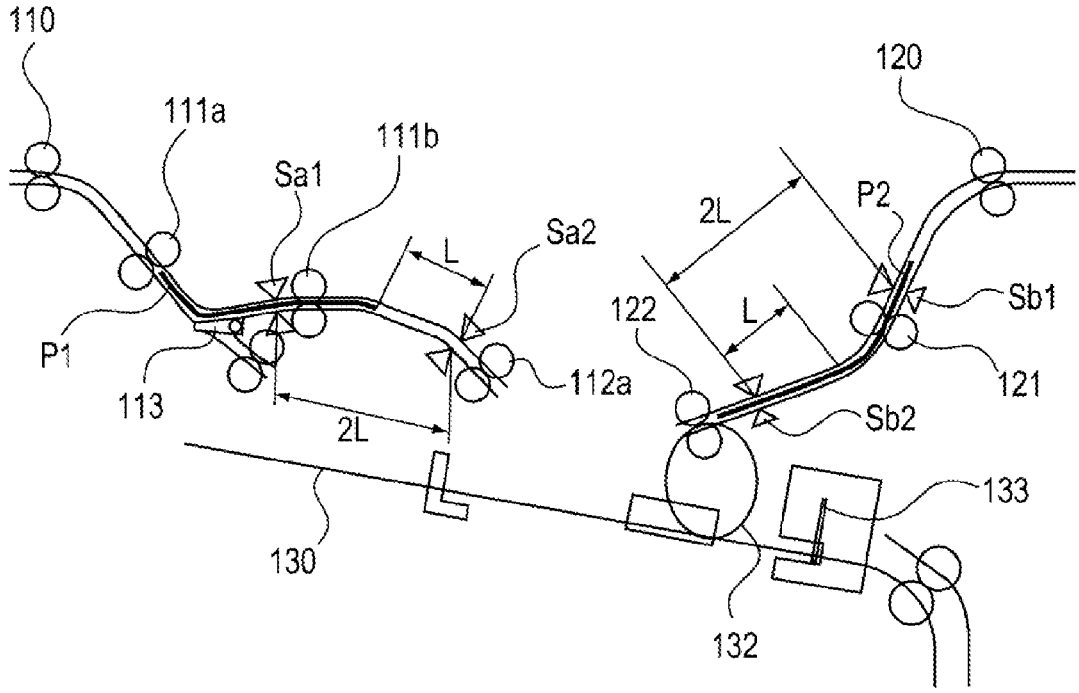
FIGS. 10A and 10B are operation illustration diagrams illustrating the stacker according to the first embodiment.

The reason for the above-mentioned arrangement is as follows. FIG. 9B is a view illustrating positions of the sheets P1 and P2 at the time when the stacker controller 210 checks the states of the sensors Sb1 and Sb2. A possibility that the leading edges of the sheets P1 and P2 conflict is highest when the sheet P1 is conveyed by a distance L from the sensor Sa2 and the leading edge of the sheet P2 is disposed slightly beyond the sensor Sb2 as illustrated in FIG. 9B. Even in this state, if the sheet P1 is temporally stopped for a time T, the sheet P2 moves by a distance $2L=T\times V$. As illustrated in FIG. 10A, the leading edge of the sheet P2 moves ahead the leading edge of the sheet P1 by the distance L. Therefore, a leading edge shifted amount of the sheets P1 and P2 is ensured as much as the distance L. As a result, with respect to required shifted amount $L0=L$ of the device conditions, the interval between the sensors S becomes a distance 2L plus $\alpha$.

Figure 10B:
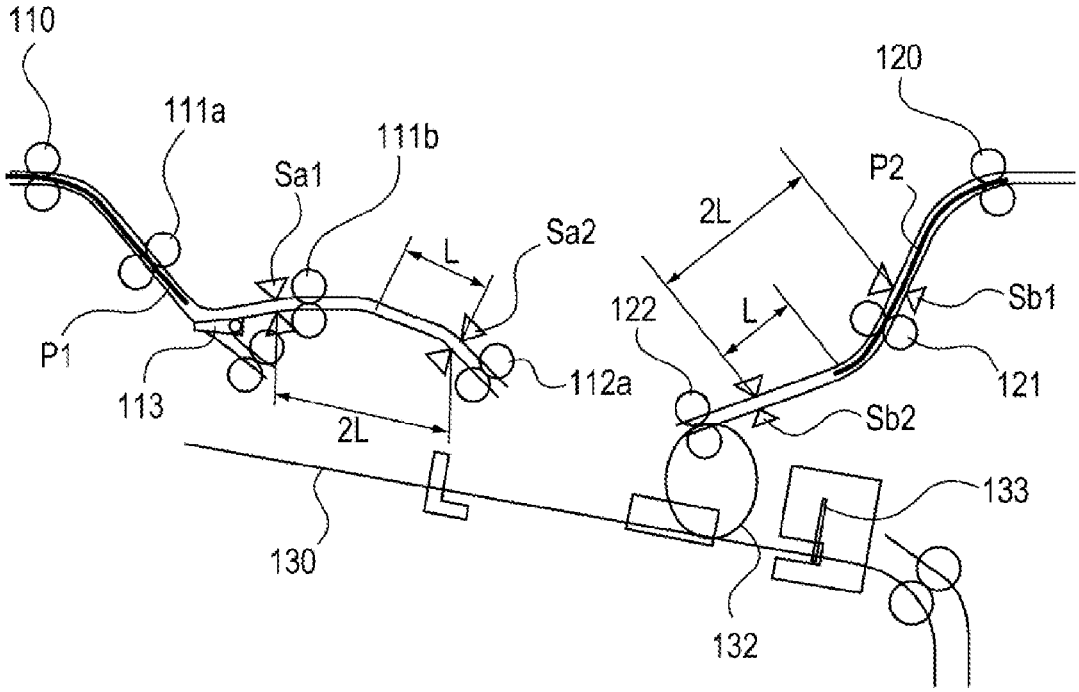
Figure 11A:
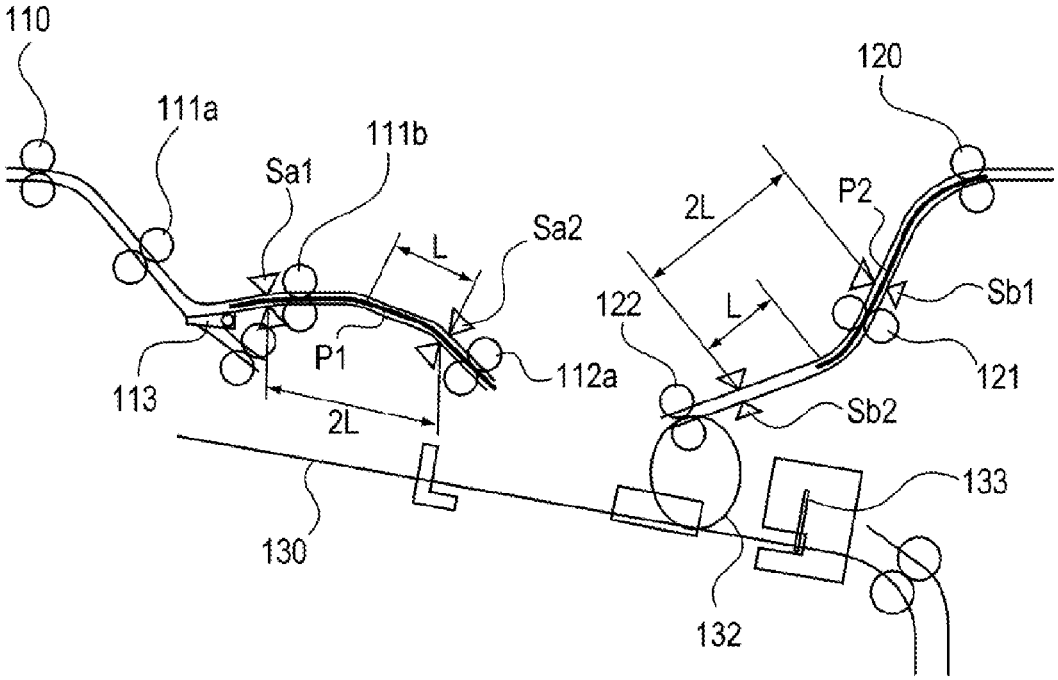
FIGS. 11A and 11B are operation illustration diagrams illustrating the stacker according to the first embodiment.
Figure 11B:
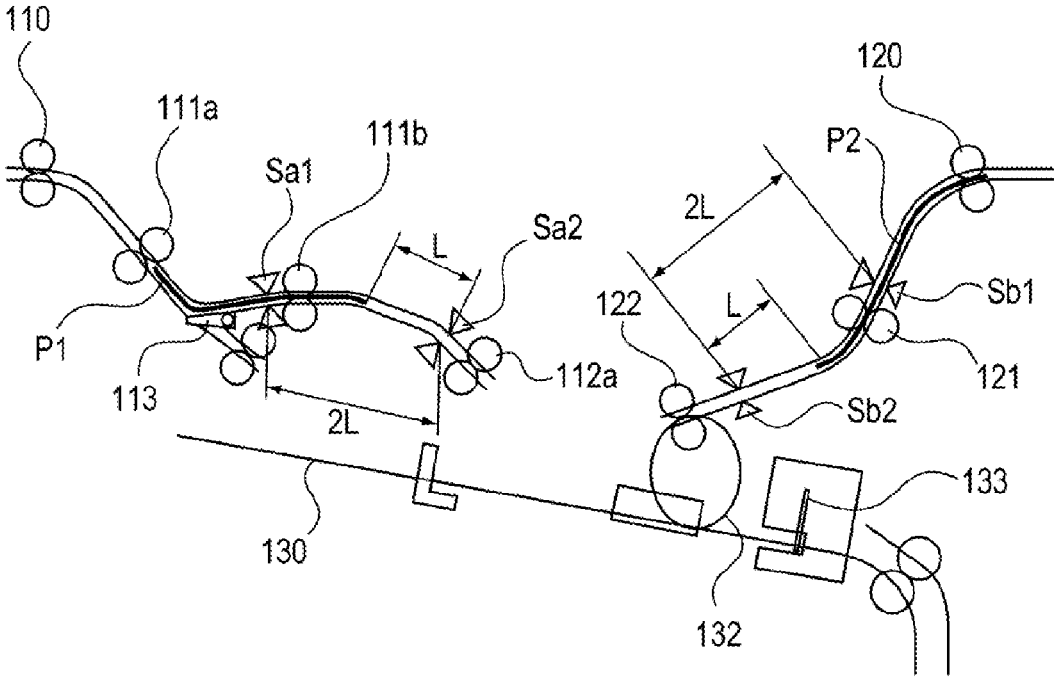
Figure 12A:
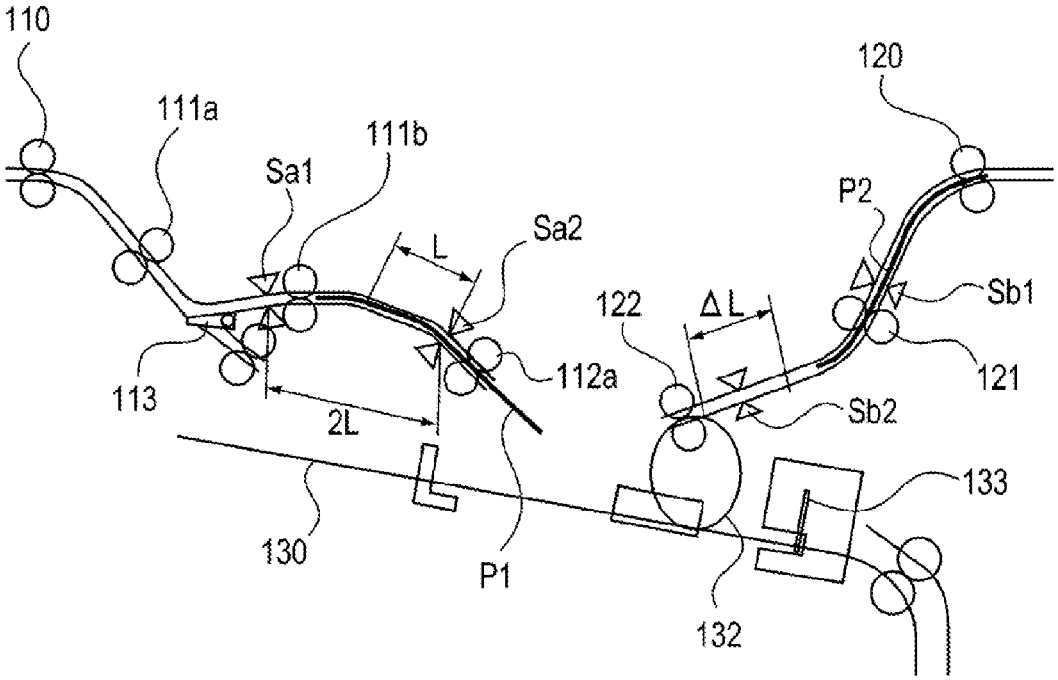
FIGS. 12A and 12B are operation illustration diagrams illustrating the stacker according to the first embodiment.
Figure 12B:
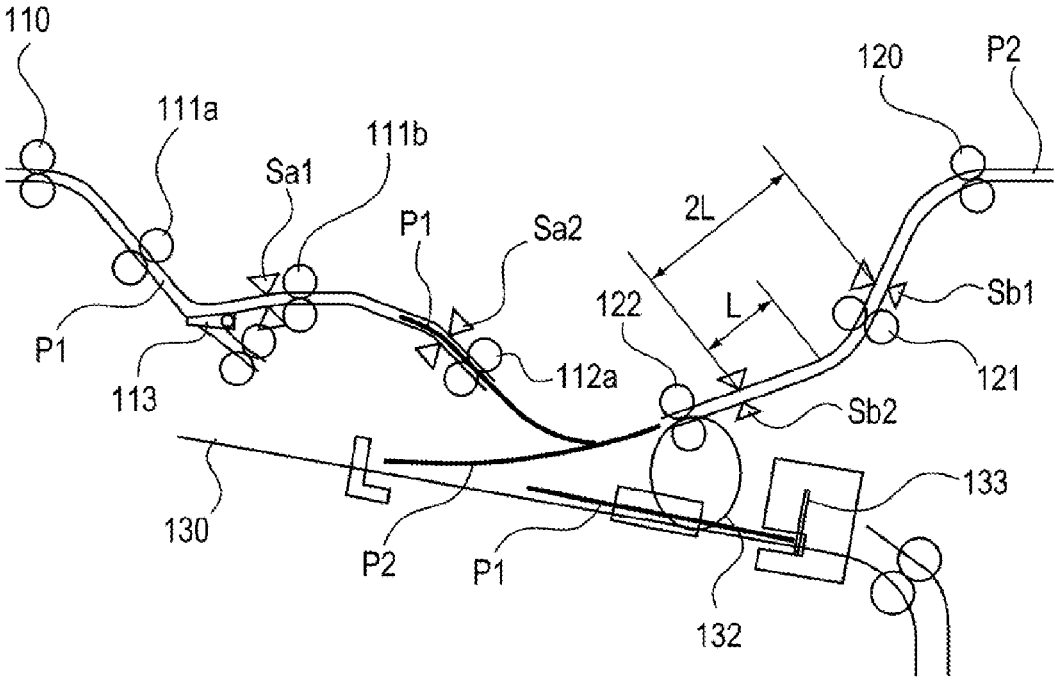

When the sheet P2 goes ahead and then the sheet P1 is conveyed, similar control is performed. As illustrated in FIG. 10B, at an instant when the sheet P2 reaches the middle point of the sensors Sb1 and Sb2, the stacker controller 210 checks the state of the sensor Sa1 that detects the existence of the sheet P1. At the instant, as illustrated in FIG. 10B, if the sensor Sa1 is off, the sheet P2 is continuously conveyed. In contrast, if the sensor Sa1 is on, the state of the sensor Sa2 is continuously checked. Here, as illustrated in FIG. 11A, if the sensor Sa2 is also on, the sheet P2 is continuously conveyed similarly. However, as illustrated in FIG. 11B, if the sensor Sa2 is off, the conveyance of the sheet P2 is stopped for a predetermined time T. While the sheet P2 is stopped for a time T, the sheet P1 is conveyed by a distance $\Delta L=V\times T$ and becomes in a state as illustrated in FIG. 12A. Further, the sheet P1 is conveyed without causing conflict of the leading edges of the sheets P1 and P2 and then discharged to the processing tray 130. Therefore, after the sheet P1 is discharged to the processing tray 130 first, as illustrated in FIG. 12B, the sheet P2 is discharged and then the sheet P1 is discharged. At this time, as illustrated in FIG. 12B, the leading edge of the sheet P1 abuts in the vicinity of a trailing edge of the sheet P2 and a force is applied to the sheet P1 in the air in the right direction in the drawing by the friction between the sheets P1 and P2. Accordingly, a left direction vector in the drawing that the sheet P2 flies so as to be separated from the aligning belt 132 and the abutting plate 133 is suppressed.

As described above, the positions of the sheets P1 and P2 are detected by the sensors Sa1, Sa2, Sb1, and Sb2 that are disposed at the upper stream of the processing tray 130 in which the sheets P1 and P2 intersect each other and conveyance stop/continuance is controlled by the stacker controller 210. By doing this, the sheets P1 and P2 are discharged in a state where the leading edges are appropriately shifted on the processing tray 130. Thus, the conflict of the leading edges of the sheets P1 and P2 can be avoided.

Further, even though a job that performs the staple processing has been described, sheets received from the first and second image forming apparatuses may be stacked on the stack tray 143 without performing the staple processing. This method is allowed by an operation that the stapler 131, the abutting plate 133, the aligning plate 134, and the bundle moving member 135 continuously wait in a retracted state (a state illustrated in FIG. 4A) and the sheets P1 and P2 are discharged while the sheets P1 and P2 overlap each other in an operation described with reference to FIGS. 6 to 12.

As described above, at a timing when the leading edges of two opposite sheets P1 and P2 do not interfere with each other, the sheets P1 and P2 can be discharged to the common processing tray and simultaneously conveyed from two image forming apparatuses to the common sheet processing apparatus, which can improve the productivity of the entire system.

Second Embodiment

An image forming system that includes a sheet processing apparatus according to a second embodiment and two image forming apparatuses that supply a sheet to the sheet processing apparatus will be described. Here, a copying machine as an image forming system having a stacker as a common sheet processing apparatus and two image forming apparatuses will be described as an example.

First, difference of the second embodiment from the first embodiment will be described. In the first embodiment, the stacker 100 detects the positions of the sheets P1 and P2 and controls to stop conveying and re-convey the sheets so as to prevent conflict of the sheets on the processing tray. The present invention is not limited thereto. In the second embodiment, the image forming apparatus detects the positions of the sheets P1 and P2 and controls a feeding timing (temporally stop/re-convey) of the sheets from the image forming apparatus to the stacker so as to prevent conflict of the leading edges of the sheets on the processing tray of the stacker.

Figure 17:
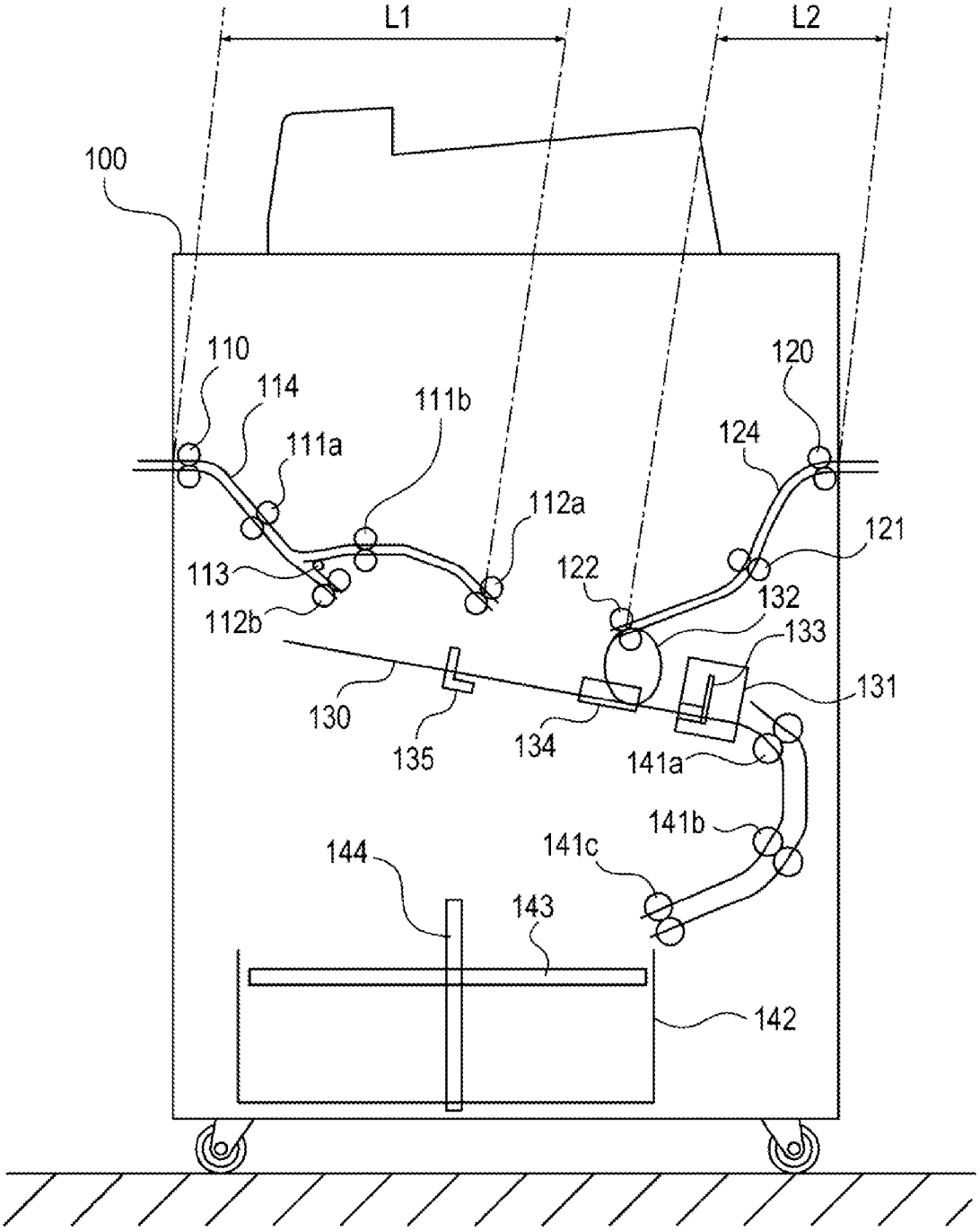
FIG. 17 is an operation illustration diagram illustrating a stacker according to a second embodiment.

Sheet conveying speeds V of the first image forming apparatus 800 and the second image forming apparatus 900 are the same. Further, the distances from feeding portions 802 and 902 to an inlet of the common stacker 100 are the same. Furthermore, as illustrated in FIG. 17, a distance L1 from an inlet of the stacker 100 close to the image forming apparatus 800 to the discharge roller 112 and a distance L2 from an inlet close to the image forming apparatus 900 to the discharge roller 122 are also the same (L1=L2).

Figure 18A:
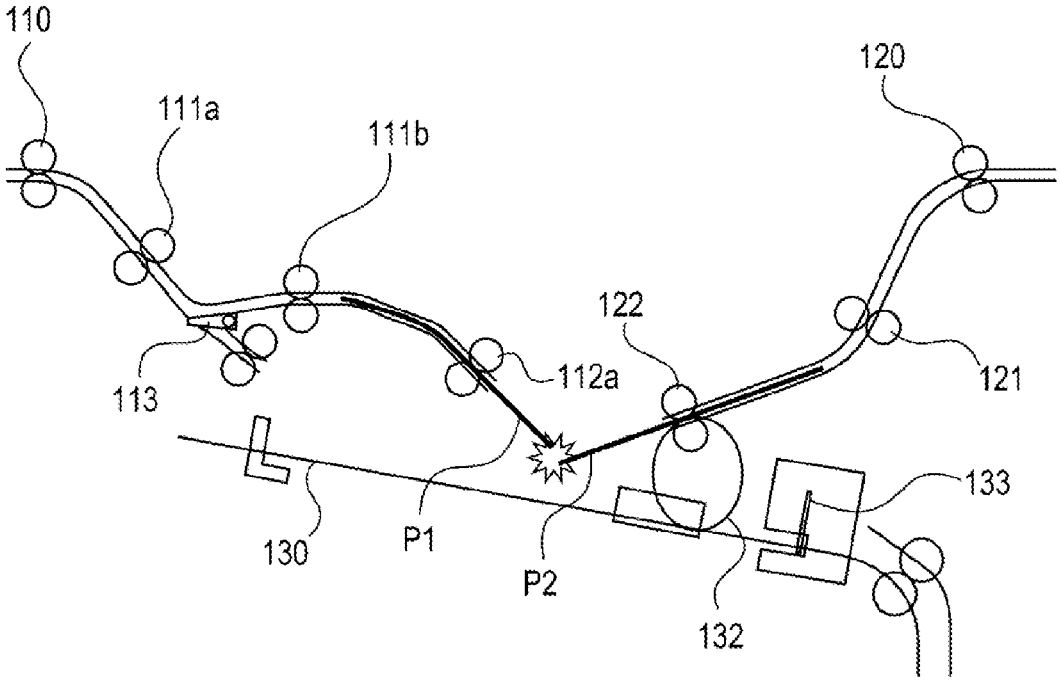
FIG. 18A is an operation illustration diagram illustrating the case when leading edges of sheets collide with each other.

Accordingly, if the feeding portions of the image forming apparatuses 800 and 900 start the feeding at the same timing, the sheets may arrive at the processing tray 130 at the same timing, which causes the conflict as illustrated in FIG. 18A.

Figure 18B:
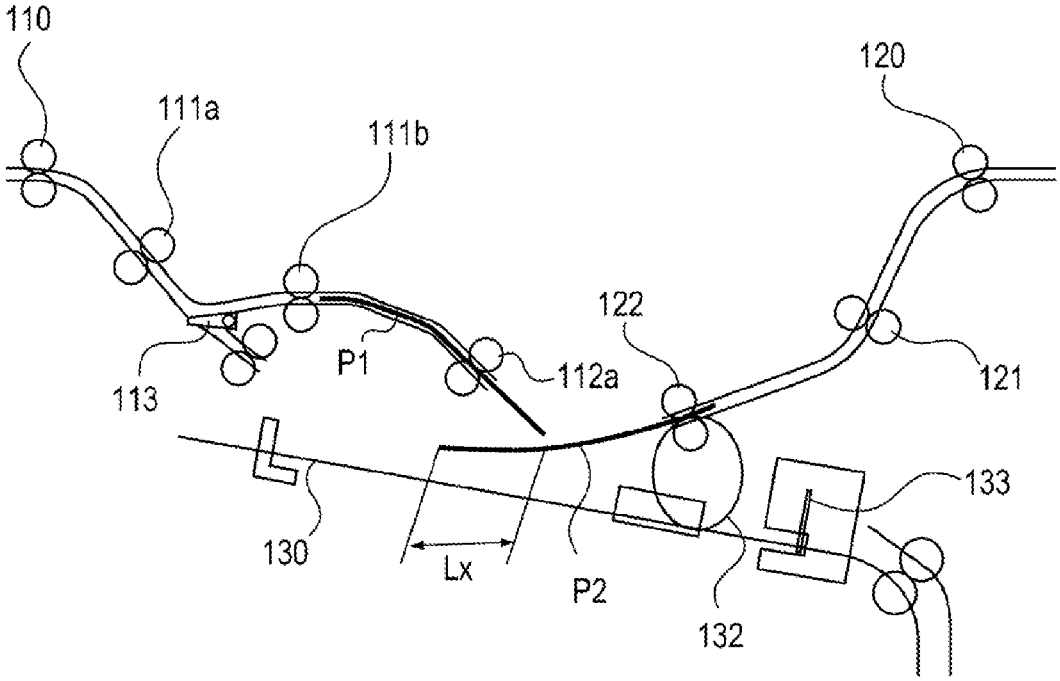
FIG. 18B is an operation illustration diagram illustrating the stacker according to the second embodiment.

In order to prevent the above problem, that is, as illustrated in FIG. 18B, for discharging the sheets P1 and P2 to the processing tray 130 in a state where the leading edges of the sheets P1 and P2 are shifted by a required distance Lx, the feeding timings of the feeding portions of the image forming apparatus 800 and the image forming apparatus 900 need to be shifted from each other. With respect to the required shifted amount (distance) Lx of the sheets P1 and P2, the feeding portions of the image forming apparatuses feed the sheets P1 and P2 with a predetermined time difference of $Tx=Lx/V$.

Figure 19:
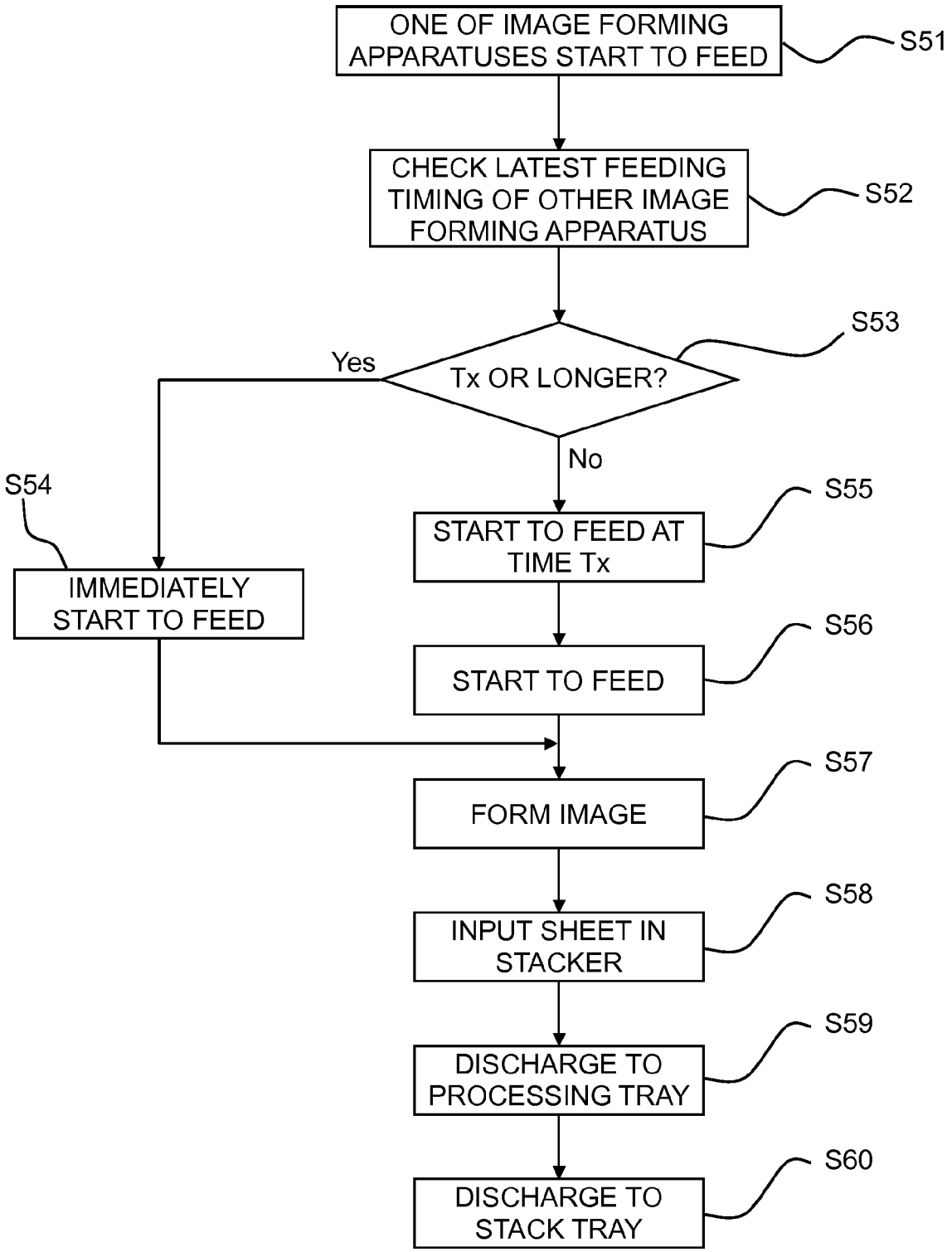
FIG. 19 is a flowchart illustrating an operation of the stacker according to the first embodiment.

As illustrated in FIG. 19, when one of the image forming apparatuses 800 starts to feed a sheet, it is checked whether the other image forming apparatus 900 feeds a sheet within a predetermined time Tx (S51 to S53 of FIG. 19). Here, if the other image forming apparatus 900 does not feed the sheet, the one image forming apparatus 800 starts to feed the sheet (S54 of FIG. 19). If the other image forming apparatus 900 feeds the sheet, after waiting for a predetermined time Tx (S55 of FIG. 19), the one image forming apparatus 800 starts to feed the sheet (S56 of FIG. 19). Similarly to the above-mentioned embodiments, the image is formed (S57 of FIG. 19), the sheet is conveyed to the common stacker 100 (S58 of FIG. 19), the sheet is discharged to the processing tray 130 (S59 of FIG. 19), and then, the sheet is discharged to the stack tray 143 (S60 of FIG. 19).

If the same control is performed when the image forming apparatus 900 feeds the sheet, without causing conflict of the leading edges of the sheets P1 and P2 on the processing tray 130, the sheets P1 and P2 can be alternately discharged and stacked in a state where the leading edges of the sheets P1 and P2 are shifted by a required distance Lx or more.

Further, as described above, since the image forming apparatus is controlled by the CPU circuit 206, the feed starting/waiting controls to drive the printer controller 205 of the image forming apparatuses 800 and 900 based on the instruction of the CPU circuit 206.

As described above, the sheets can be discharged to the common processing tray at a timing when the leading edges of two opposite sheets P1 and P2 do not interfere with each other and the sheets can be simultaneously discharged from the two mage forming apparatuses to the common sheet processing apparatus, which can improve the productivity of the entire system.

Further, in the above-mentioned embodiment, even though the copying machine is described as an example of an image forming apparatus, the present invention is not limited thereto. For example, the image forming apparatus may be other image forming apparatus such as a printer or a facsimile or other image forming apparatus such as a complex machine that combines the functions. By applying the invention to the image forming system including the image forming apparatus and the sheet processing apparatus, the same advantageous effect can be obtained.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-032392, filed Feb. 17, 2012, which is hereby incorporated by reference herein in its entirety.

What is claimed is:

1. A sheet processing apparatus that stacks sheets received from two image forming apparatuses in a processing portion and processes a sheet on the processing portion, comprising:

a first discharging portion that comprises a pair of discharge rollers and discharges a sheet received from one of the two image forming apparatuses to the processing off;

a second discharging portion that is disposed so as to be opposite to the first discharging portion with respect to the processing portion and discharges a sheet received from the other image forming apparatus of the two image forming apparatuses to the processing portion; and a controller that controls the first discharging portion and the second discharging portion, wherein the pair of discharge rollers of the first discharging portion is disposed so that a nipping line extending from a nipping point of the discharge rollers and being perpendicular to a line passing through both rotary centers of the discharge rollers inclines in a sheet discharge direction downward so as to extend below a horizontal line extending horizontally in the sheet discharge direction from the nipping point, and when the sheets are continuously discharged by the first discharging portion and the second discharging portion to the processing portion, the controller controls the first discharging portion and the second discharging portion such that a leading edge of the sheet discharged by the second discharging portion abuts on a sheet surface of the sheet being discharged by the first discharging portion to drop the sheet down on the processing portion which is disposed below the first discharging portion and the second discharging portion.

2. The sheet processing apparatus according to claim 1, further comprising:

a first detecting portion that detects a position of the sheet received from the one of the image forming apparatuses; and a second detecting portion that detects a position of the sheet received from the other image forming apparatus, wherein the controller temporally stops one of the two discharging portions that receive the sheets from the image forming apparatuses based on positional information of the sheets detected by the first detecting portion and the second detecting portion to shift discharging timings of the sheets by the first discharging portion and the second discharging portion.

3. The sheet processing apparatus according to claim 1, wherein the controller controls the first discharging portion and the second discharging portion so as to alternately discharge the sheets by the first discharging portion and the second discharging portion.

4. The sheet processing apparatus according to claim 1, wherein a pair of discharge rollers of the second discharging portion is disposed so that a nipping line extending from a nipping point of the discharge rollers and being perpendicular to a line passing through both rotary centers of the discharge rollers inclines in a sheet discharge direction downward so as to extend below a horizontal line extending horizontally in the sheet discharge direction from the nipping point, and the controller controls the first discharging portion and the second discharging portion such that a leading edge of the sheet discharged by the first discharging portion abuts on a sheet surface of the sheet being discharged by the second discharging portion.

5. An image forming system, comprising:

two image forming apparatuses each including an image forming portion that forms an image on a sheet;

a processing portion on which sheets, to be processed, received from the two image forming apparatuses are stacked;

a first discharging portion that comprises a pair of discharge rollers and discharges a sheet received from one of the two image forming apparatuses to the processing portion;

a second discharging portion that is disposed so as to be opposite to the first discharging portion with respect to the processing portion and discharges a sheet received from the other image forming apparatus of the two image forming apparatuses to the processing portion; and a controller that controls the first discharging portion and the second discharging portion, wherein the pair of discharge rollers of the first discharging portion is disposed so that a nipping line extending from a nipping point of the discharge rollers and being perpendicular to a line passing through both rotary centers of the discharge rollers inclines in a sheet discharge direction downward so as to extend below a horizontal line extending horizontally in the sheet discharge direction from the nipping point, and when the sheets are continuously discharged by the first discharging portion and the second discharging portion to the processing portion, the controller controls such that a leading edge of the sheet discharged by the second discharging portion abuts on a sheet surface of the sheet being discharged from the first discharging portion to drop the sheet down on the processing portion which is disposed below the first discharging portion and the second discharging portion.

6. The image forming system according to claim 5, further comprising:

a first detecting portion that detects a position of the sheet received from the one of the image forming apparatuses; and a second detecting portion that detects a position of the sheet received from the other image forming apparatus, wherein the controller temporally stops one of the two discharging portions that receive the sheets from the image forming apparatuses based on positional information of the sheets detected by the first detecting portion and the second detecting portion to shift discharging timings of the sheets by the first discharging portion and the second discharging portion.

7. The image forming system according to claim 5, wherein the controller controls the first discharging portion and the second discharging portion so as to alternately discharge the sheets by the first discharging portion and the second discharging portion.

8. The sheet processing apparatus according to claim 5, wherein a pair of discharge rollers of the second discharging portion is disposed so that a nipping line extending from a nipping point of the discharge rollers and being perpendicular to a line passing through both rotary centers of the discharge rollers inclines in a sheet discharge direction downward so as to extend below a horizontal line extending horizontally in the sheet discharge direction from the nipping point, and the controller controls the first discharging portion and the second discharging portion such that a leading edge of the sheet discharged by the first discharging portion abuts on a sheet surface of the sheet being discharged by the second discharging portion.

9. An image forming system, comprising:

two image forming apparatuses each including a feeding portion that feeds a sheet and an image forming portion that forms an image on the sheet;

a processing portion on that sheets, to be processed, received from the two image forming apparatuses are stacked;

a first discharging portion that comprises a pair of discharge rollers and discharges a sheet received from one of the two image forming apparatuses to the processing off;

a second discharging portion that is disposed so as to be opposite to the first discharging portion with respect to the processing portion and discharges a sheet received from the other image forming apparatus of the two image forming apparatuses to the processing portion; and a controller that controls feeding portions of the two image forming apparatuses, wherein the pair of discharge rollers of the first discharging portion is disposed so that a nipping line extending from a nipping point of the discharge rollers and being perpendicular to a line passing through both rotary centers of the discharge rollers inclines in a sheet discharge direction downward so as to extend below a horizontal line extending horizontally in the sheet discharge direction from the nipping point, and when the sheets are continuously discharged by the first discharging portion and the second discharging portion to the processing portion, the controller controls the feeding portions such that a leading edge of the sheet discharged from the second discharging portion abuts on a sheet surface of the sheet being discharged by the first discharging portions to drop the sheet down on the processing portion which is disposed below the first discharging portion and the second discharging portion.

10. The image forming system according to claim 9, wherein when the other image forming apparatus starts to feed the sheet within a predetermined time before one of the image forming apparatuses starts to feed the sheet, the controller starts to feed the sheet after waiting for the predetermined time and feeding timings of the sheets by the feeding portions of the two image forming apparatuses are shifted.

11. The image forming system according to claim 9, wherein the controller controls the feeding portions so as to alternately discharge the sheets fed by the feeding portions of the two image forming apparatuses.

12. The sheet processing apparatus according to claim 9, wherein a pair of discharge rollers of the second discharging portion is disposed so that a nipping line extending from a nipping point of the discharge rollers and being perpendicular to a line passing through both rotary centers of the discharge rollers inclines in a sheet discharge direction downward so as to extend below a horizontal line extending horizontally in the sheet discharge direction from the nipping point, and the controller controls the first discharging portion and the second discharging portion such that a leading edge of the sheet discharged by the first discharging portion abuts on a sheet surface of the sheet being discharged by the second discharging portion.

13. An apparatus comprising:

a stacking portion on which sheets are stacked;

a first discharging portion that comprises a pair of discharge rollers and discharges a sheet to the stacking portion, wherein the pair of discharge rollers of the first discharging portion is disposed so that a nipping line extending from a nipping point of the discharge rollers and being perpendicular to a line passing through both rotary centers of the discharge rollers inclines in a sheet discharge direction downward so as to extend below a horizontal line extending horizontally in the sheet discharge direction from the nipping point;

a second discharging portion that is disposed so as to be opposite to the first discharging portion with respect to the stacking portion and discharges a sheet to the stacking portion; and a controller that controls such that a leading edge of the sheet discharged by the second discharging portions abuts on a sheet surface of the sheet being discharged by the first discharging portion, when the sheets are continuously discharged by the first discharging portion and the second discharging portion to the stacking portion to drop the sheet down on the processing portion which is disposed below the first discharging portion and the second discharging portion.

14. The apparatus according to claim 13, further comprising:

a first detecting portion that detects a position of a sheet to be discharged by the first discharging portion; and a second detecting portion that detects a position of a sheet to be discharged by the second discharging portion, wherein the controller temporally stops one of the two discharging portions based on positional information of the sheets detected by the first detecting portion and the second detecting portion to shift discharging timings of the sheets by the first discharging portion and the second discharging portion.

15. The apparatus according to claim 13, wherein the controller controls the first discharging portion and the second discharging portion so as to alternately discharge the sheets by the first discharging portion and the second discharging portion.

16. The sheet processing apparatus according to claim 13, wherein a pair of discharge rollers of the second discharging portion is disposed so that a nipping line extending from a nipping point of the discharge rollers and being perpendicular to a line passing through both rotary centers of the discharge rollers inclines in a sheet discharge direction downward so as to extend below a horizontal line extending horizontally in the sheet discharge direction from the nipping point, and the controller controls the first discharging portion and the second discharging portion such that a leading edge of the sheet discharged by the first discharging portion abuts on a sheet surface of the sheet being discharged by the second discharging portion.

* * * * *